US009663310B2

(12) United States Patent
Hirajima

(10) Patent No.: US 9,663,310 B2
(45) Date of Patent: May 30, 2017

(54) SHEET FEEDING DEVICE AND IMAGE FORMING APPARATUS

(71) Applicant: CANON KABUSHIKI KAISHA, Tokyo (JP)

(72) Inventor: Marehiko Hirajima, Chigasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/165,367

(22) Filed: May 26, 2016

(65) Prior Publication Data

US 2016/0355355 A1 Dec. 8, 2016

(30) Foreign Application Priority Data

Jun. 3, 2015 (JP) ..... 2015-113070

(51) Int. Cl.
*B65H 1/08* (2006.01)
*B65H 1/04* (2006.01)
(Continued)

(52) U.S. Cl.
CPC ..... *B65H 1/08* (2013.01); *B65H 1/04* (2013.01); *B65H 1/14* (2013.01); *B65H 1/18* (2013.01); *B65H 1/266* (2013.01); *B65H 3/0684* (2013.01); *B65H 7/02* (2013.01); *B65H 7/14* (2013.01); *B65H 7/20* (2013.01); *G03G 15/6511* (2013.01); *G03G 15/6529* (2013.01);
(Continued)

(58) Field of Classification Search
CPC ... B65H 1/08; B65H 1/14; B65H 1/18; B65H 3/06; B65H 3/0607; B65H 3/0684; B65H 7/02; B65H 7/14; B65H 7/18; B65H 7/20; B65H 2405/1117; B65H 2513/50; B65H 2513/53
See application file for complete search history.

(56) References Cited

U.S. PATENT DOCUMENTS

2011/0140356 A1* 6/2011 Katayama ..... B65H 1/14 271/265.01
2015/0151935 A1* 6/2015 Murakami ..... B65H 1/14 271/3.19
(Continued)

FOREIGN PATENT DOCUMENTS

JP 2002-255369 A 9/2002
JP 2003-171024 A 6/2003
(Continued)

*Primary Examiner* — Prasad Gokhale
(74) *Attorney, Agent, or Firm* — Fitzpatrick, Cella, Harper & Scinto

(57) ABSTRACT

A sheet feeding device includes a raising and lowering portion, a first detecting portion, a feeding portion, a second detecting portion, and a controller. When a change in a state of the feeding roller from a state of being in an uppermost sheet feedable position to a state of being not in the uppermost sheet feedable position is detected by the second detecting portion and then a change in a state of the uppermost sheet from a state of being in a feeding position to a state of being not in the feeding position is detected by the first detecting portion, the controller controls the raising and lowering portion to raise the stacking member on the basis of a correction amount determined based on a time from change timing of the second detecting portion to change timing of the first detecting portion.

16 Claims, 13 Drawing Sheets

(51) Int. Cl.

| | |
|---|---|
| ***B65H 3/06*** | (2006.01) |
| ***B65H 7/02*** | (2006.01) |
| ***B65H 1/26*** | (2006.01) |
| ***B65H 7/20*** | (2006.01) |
| ***B65H 7/14*** | (2006.01) |
| ***G03G 15/00*** | (2006.01) |
| ***B65H 1/18*** | (2006.01) |
| ***B65H 1/14*** | (2006.01) |

(52) U.S. Cl.
CPC *B65H 2405/1117* (2013.01); *B65H 2405/313* (2013.01); *B65H 2513/50* (2013.01); *G03G 2215/004* (2013.01); *G03G 2215/00396* (2013.01); *G03G 2215/0132* (2013.01)

(56) References Cited

U.S. PATENT DOCUMENTS

| | | | | |
|---|---|---|---|---|
| 2015/0197402 | A1* | 7/2015 | Yamaoka | B65H 7/02<br>271/153 |
| 2015/0259162 | A1* | 9/2015 | Osada | B65H 3/06<br>271/117 |
| 2015/0284195 | A1* | 10/2015 | Kushida | B65H 1/14<br>271/152 |

FOREIGN PATENT DOCUMENTS

| | | | |
|---|---|---|---|
| JP | 2009-214966 | A | 9/2009 |
| JP | 2009-215041 | A | 9/2009 |

* cited by examiner (a)

(b)

(a)

(b)

(a)

(b)

SHEET FEEDING DEVICE AND IMAGE FORMING APPARATUS

FIELD OF THE INVENTION AND RELATED ART

The present invention relates to a sheet feeding device and an image forming apparatus and particularly relates to a position control of a sheet stacking member capable of raising and lowering.

The image forming apparatus includes the sheet feeding device, in some cases, which includes a lifter mechanism for maintaining a height of an uppermost sheet of sheets stacked on the sheet stacking member at a substantially constant level and which feeds the sheet from the substantially constant height to an image forming portion by a feeding roller. The sheet feeding device includes a detecting sensor for detecting whether or not the sheet stacked on the sheet stacking member reaches a sheet feeding position, and on the basis of a detection result of the detecting sensor, raising and lowering of the sheet stacking member is controlled. By such control, the sheet feeding device is capable of maintaining the sheet feeding position at a substantially constant position, so that a sheet feeding operation can be stabilized. In the case where an uppermost surface of sheets stacked on the sheet stacking member fluctuates by the influence of a curl of the sheet(s) at an end portion, the detecting sensor is influenced by the curl, so that an erroneous detection as if the uppermost surface of the sheets reach the feeding position is made in some instances. For example, in Japanese Laid-Open Patent Application (JP-A) 2009-214966, after start of feeding, in the case where a detecting sensor detects plural times that an uppermost sheet of sheets stacked on a sheet stacking member does not reach a feeding position, control for raising the sheet stacking member is effected. In JP-A 2009-215041, a detecting mechanism for detecting a curl state of a sheet is provided and control such that a position of a sheet stacking member is adjusted by raising and lowering the sheet stacking member depending on a curl amount of the sheet is effected.

In recent years, in order to realize downsizing of the image forming apparatus, in the case where the image forming apparatus includes two sheet feeding openings 1 and 2 for permitting feeding of sheets, the following constitution would be considered. That is, such a constitution that an independent feeding path is not provided every sheet feeding opening and a feeding path from a feeding roller toward a downstream side with respect to a (sheet) feeding direction is used in common and then the sheet is fed through the common feeding path would be considered. For example, in the case where the sheet feeding opening 1 is a manually sheet feeding opening and the sheet feeding opening 2 is a cassette including a lifter mechanism, a sheet fed from the sheet feeding opening 1 is fed between a sheet feeding roller for the sheet feeding opening and a sheet being in stand-by at a feeding position. For that reason, in order to feed the sheet fed from the sheet feeding opening 1 to the image forming portion, there is a need to ensure a feeding path by retracting the sheet feeding roller from the sheet stacked on the sheet stacking member of the cassette. On the other hand, in a state in which the sheet feeding roller is retracted, even when the sheet stacking member on which the sheets are stacked is raised to the feeding position by the lifter mechanism, urging by the sheet feeding roller is not exerted on the sheets. For example, in the case where the sheet curls, when the sheet feeding roller lowers to an uppermost surface of the sheets stacked on the sheet stacking member in order to perform a sheet feeding operation, the sheet feeding roller urges the uppermost surface of the sheets, so that a position of the sheet surface is pushed down. As a result, there arises a problem such that the position of the uppermost surface of the sheets stacked on the sheet stacking member is lower than an optimum feeding position and thus improper feeding generates.

SUMMARY OF THE INVENTION

In the above-described circumstances, the present invention has been accomplished. A principal object of the present invention is to provide a sheet feeding device and an image forming apparatus which are capable of stably feeding a sheet even in a state in which the sheet curls.

According to an aspect of the present invention, there is provided a sheet feeding device comprising: a raising and lowering portion for raising and lowering a stacking member for stacking a sheet; a first detecting portion for detecting whether or not an uppermost sheet stacked on the stacking member raised by the raising and lowering portion is in a feeding position; a feeding portion for feeding the uppermost sheet by causing a feeding roller to press-contact the uppermost sheet; a second detecting portion for detecting whether or not the feeding roller is in a position where the feeding roller is capable of feeding the uppermost sheet; and a controller for controlling the raising and lowering portion, wherein the raising and lowering portion raises the stacking member and detection that the uppermost sheet is in the feeding position is made by the first detecting portion, and thereafter the feeding portion causes the feeding roller to press-contact the uppermost sheet, and wherein when a change in a state of the feeding roller from a state in which the feeding roller is in the position where the feeding roller is capable of feeding the uppermost sheet to a state in which the feeding roller is not in the position where the feeding roller is capable of feeding the uppermost sheet is detected by the second detecting portion and then a change in a state of the sheet from a state in which the sheet is in the feeding position to a state in which the sheet is not in the feeding position is detected by the first detecting portion, the controller determines a correction amount on the basis of a time from change timing of the second detecting portion to change timing of the first detecting portion and controls the raising and lowering portion to raise the stacking member on the basis of a correction amount.

According to another aspect of the present invention, there is provided an image forming apparatus comprising: a raising and lowering portion for raising and lowering a stacking member for stacking a sheet; a first detecting portion for detecting whether or not an uppermost sheet stacked on the stacking member raised by the raising and lowering portion is in a feeding position; a feeding portion for feeding the uppermost sheet by causing a feeding roller to press-contact the uppermost sheet; a second detecting portion for detecting whether or not the feeding roller is in a position where the feeding roller is capable of feeding the uppermost sheet; and a controller for controlling the raising and lowering portion, wherein the raising and lowering portion raises the stacking member and detection that the uppermost sheet is in the feeding position is made by the first detecting portion, and thereafter the feeding portion causes the feeding roller to press-contact the uppermost sheet, and wherein when a change in a state of the feeding roller from a state in which the feeding roller is in the position where the feeding roller is capable of feeding the uppermost sheet to a state in which the feeding roller is not in the position where the feeding roller is capable of feeding the uppermost sheet is detected by the second detecting portion and then a change in a state of the sheet from a state in which the sheet is in the feeding position to a state in which the sheet is not in the feeding position is detected by the first detecting portion, the controller determines a correction amount on the basis of a time from change timing of the second detecting portion to change timing of the first detecting portion and controls the raising and lowering portion to raise the stacking member on the basis of a correction amount.

Further features of the present invention will become apparent from the following description of exemplary embodiments with reference to the attached drawings.

DESCRIPTION OF THE EMBODIMENTS

Embodiments of the present invention will be described specifically with reference to the drawings.

Embodiment 1

[General Structure of Image Forming Apparatus]

Figure 1A:
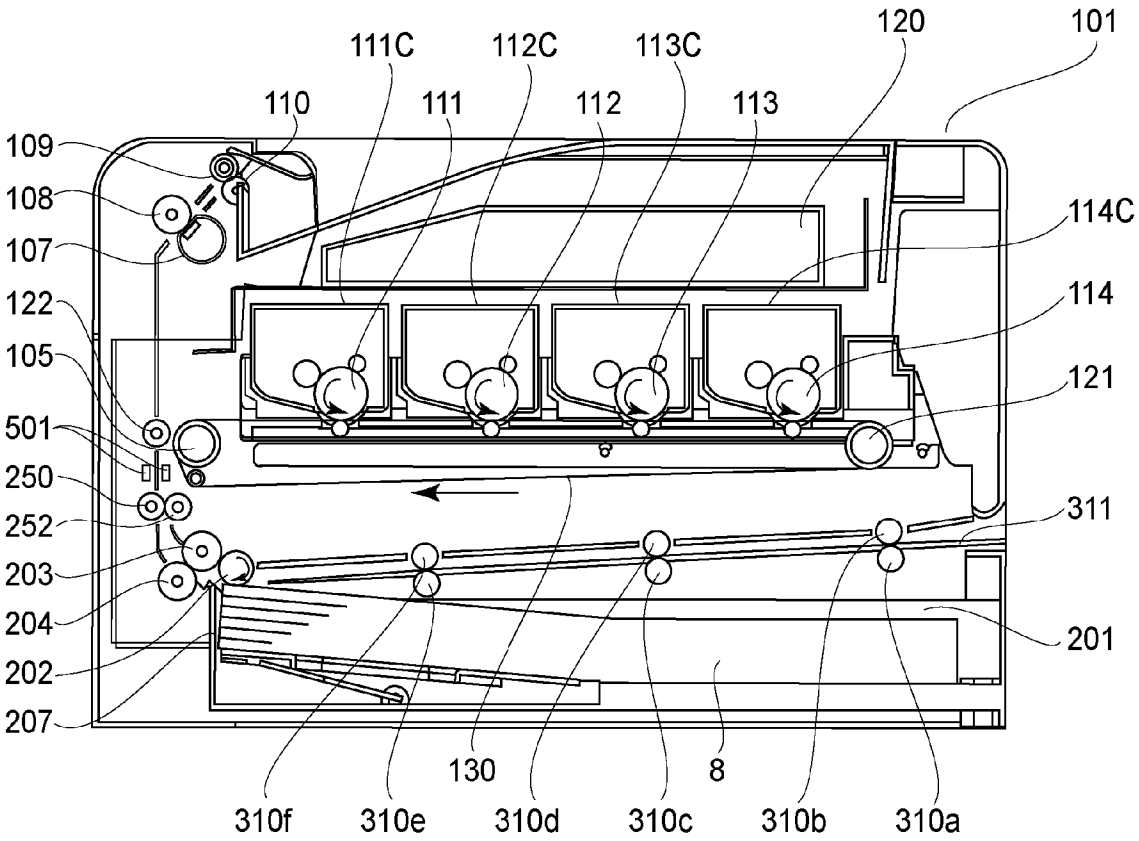
FIG. 1A is a schematic sectional view of an image forming apparatus in Embodiments 1-3.

An outline of a general structure of an image forming apparatus in Embodiment 1 with reference to FIG. 1 will be described. In this embodiment, as the image forming apparatus, a laser beam printer 101 in which toner images of respective colors are successively transferred from photosensitive drums onto an intermediary transfer belt and thereafter are collectively transferred from the intermediary transfer belt onto a sheet as a recording material (medium) is used. Here, the sheet includes recording paper (thin paper, plain paper, thick paper), an OHP sheet and the like. In this embodiment, description will be made using the recording paper as an example. FIG. 1A is a schematic sectional view of the laser beam printer 101 (hereinafter also referred to as a main assembly 101). Sheets 8 stacked in a sheet feeding cassette 201 are fed one by one by a sheet feeding roller 202, rotating in an arrow direction (clockwise direction) in the figure, toward a retarding roller 204 opposing a feed roller 203. The sheet 8 passed through the feed roller 203 is fed to a nip between a conveying roller 250 and a conveying opposite roller 252 and is further conveyed to a nip between a driving roller 105 and a transfer roller 122. Oppositely to a feeding (conveying) path between the conveying roller 250 and the transfer roller 122, a media sensor 501 is provided and detects a surface property and a thickness of the sheet 8 fed (conveyed) and on the basis of a detection result, a species of the sheet 8 is discriminated. Depending on the discriminated species of the sheet 8, an image forming portion described later effects image formation under an optimum image forming condition. Incidentally, the media sensor 501 is used in Embodiment 3 described later, and therefore may also be not disposed in Embodiments 1 and 2.

Cartridges 111C, 112C, 113C, 114C form toner images using toners of yellow, magenta, cyan, black, respectively. The cartridges 111C, 112C, 113C, 114C include photosensitive drums 111, 112, 113, 114, respectively, which rotate in arrow directions (counterclockwise direction) in the figure. On the photosensitive drums 111-114, electrostatic latent images are successively formed by laser light from a laser scanner 120. The formed electrostatic latent images are developed by detecting rollers though deposition of the toners, so that toner images of the respective colors are formed on the photosensitive drums 111-114. An intermediary transfer belt 130 is an endless belt and is stretched by the driving roller 105, a tension roller 121 and the like, and rotates in an arrow direction (clockwise direction) in the figure. The toner images of yellow, magenta, cyan, black formed on the photosensitive drums 111, 112, 113, 114, respectively, are successively transferred superposedly onto the intermediary transfer belt 130. Then, the toner images superposedly transferred on the intermediary transfer belt 130 are collectively transferred onto the sheet 8 fed to the nip between the transfer roller 122 and the driving roller 105 for driving the intermediary transfer belt 130.

Then, the sheet 8 on which the toner images are transferred is fed to a nip between a fixing film 107 and a pressing roller 108 which constitute a fixing device, where a heating and pressing process is performed, so that the toner images are fixed on the sheet 8. Thereafter, the sheet 8 on which the toner images are fixed is discharged to an outside of the main assembly 101 by discharging rollers 109 and 110.

[System Constitution of Image Forming Apparatus]

Figure 1B:
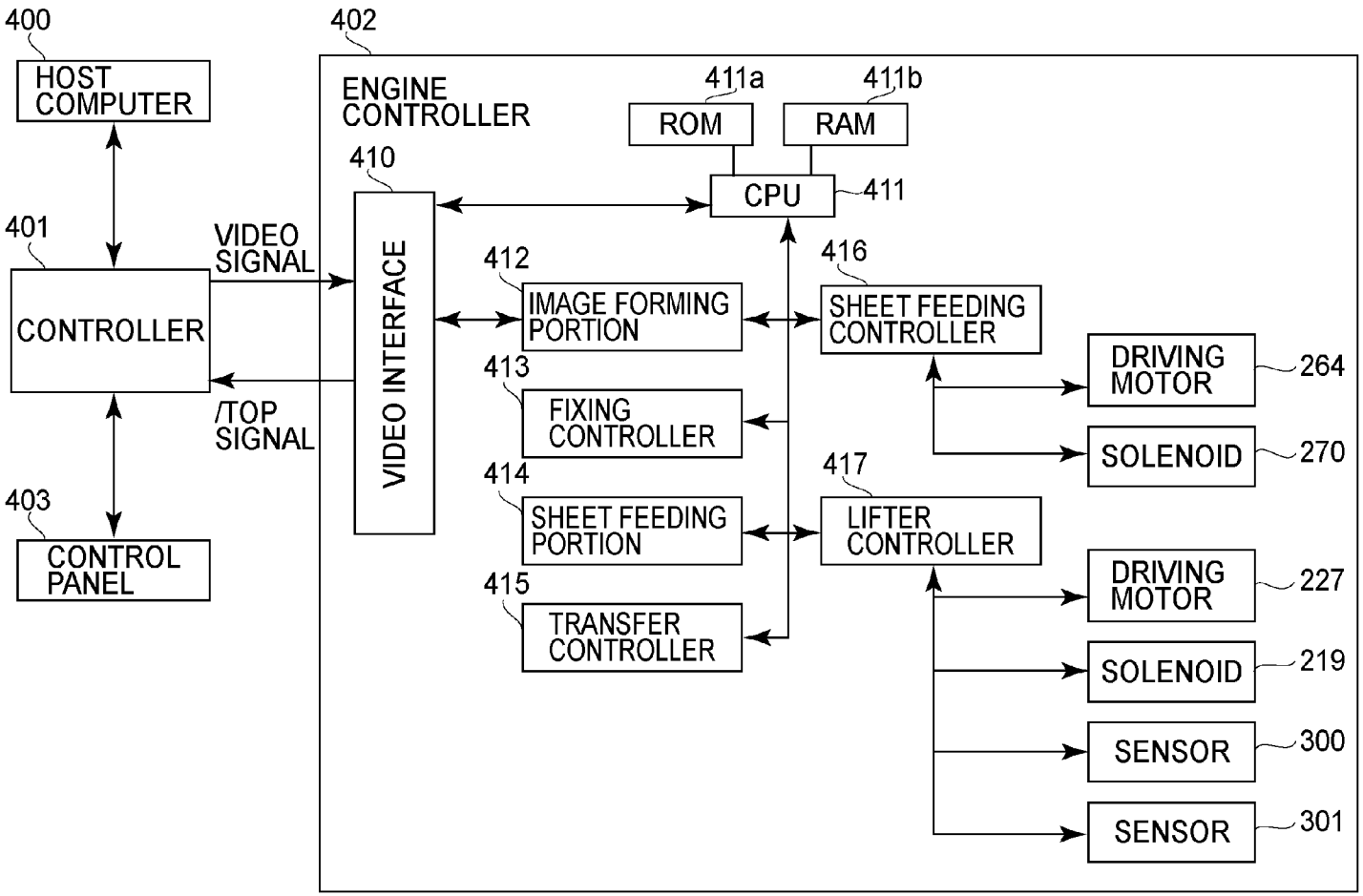
FIG. 1B is a block diagram of a system constitution in Embodiments 1-3.

FIG. 1B is a block diagram showing a system constitution of the image forming apparatus in this embodiment.

A controller (portion) 401 is capable of communicating with each of a host computer 400, an engine controller 402 and a control panel 403. When the controller 401 receives image information and a print instruction from the host computer 400 as an external device, the controller 401 analyzes the received image information and converts the image information into bit data. Then, the controller 401 sends a print reservation command, a print start command and a video signal to the engine controller 402 via a video interface 410 for each of the sheets 8. Further, the controller 401 displays information on a state of the image forming apparatus or the like on the control panel 403 as a notifying portion in order to notify a user of the information. The controller 401 sends the print reservation command to the engine controller 402 in accordance with the print instruction from the host computer 400. The controller 401 sends the print start command to the engine controller 402 at timing when the image forming apparatus is in a printable state.

The engine controller 402 makes preparation for executing a printing operation in the order of the print reservation command received from the controller 401, and is in standby until the engine controller 402 receives the print start command from the controller 401. When the engine controller 402 receives the print start command (print instruction) from the controller 401, the engine controller outputs/TOP signal providing reference timing of an output of the video signal to the controller 401, and starts the printing operation in accordance with the received print reservation command. In the engine controller 402, CPU 411 as a controller controls an image forming portion 412, a fixing controller 413, a sheet feeding portion 414, a transfer controller 415, a sheet feeding controller 416 and a lifter controller 417, and thus executes an image forming process necessary for the printing operation.

The sheet feeding controller 416 as a feeding portion controls a driving motor 264 for driving a sheet feeding portion and a solenoid 270 and thus controls sheet feeding of the sheet 8 by the sheet feeding roller 202. The lifter controller 417 effects control a driving motor 227 for driving a lift-up portion (sheet stacking member 206 described later), a solenoid 219, a sensor 300 for detecting a state of the lift-up portion, and a sensor 301. As a result, the lifter controller 417 effect raising and lowering control of the lift-up portion. The CPU 411 effects control of the controllers described above while using RAM 411*b* as a working area in accordance with various programs stored in ROM 411*a*. Further, the CPU 411 has a timer function for measuring a time.

Incidentally, as described later, the sheet feeding controller 416 and the lifter controller 417 are provided in the sheet feeding cassette 201 and are controlled by the CPU 411 of the engine controller 402. For example, a constitution in which in the sheet feeding cassette 201, a controller (CPU or the like) for controlling the sheet feeding controller 416 and the lifter controller 417 is provided, and depending on a sheet feeding instruction from the CPU 411, the sheet feeding controller 416 and the lifter controller 417 are controlled may also be employed. That is, the controller controls the sheet feeding controller 416 depending on the sheet feeding instruction from the CPU 411 and thus effects the sheet feeding of the sheet 8 by the sheet feeding roller 202, and controls the lifter controller 417 and thus effects the raising and lowering control of the lift-up portion.

[Structure of Sheet Feeding Device]

Figure 2A:
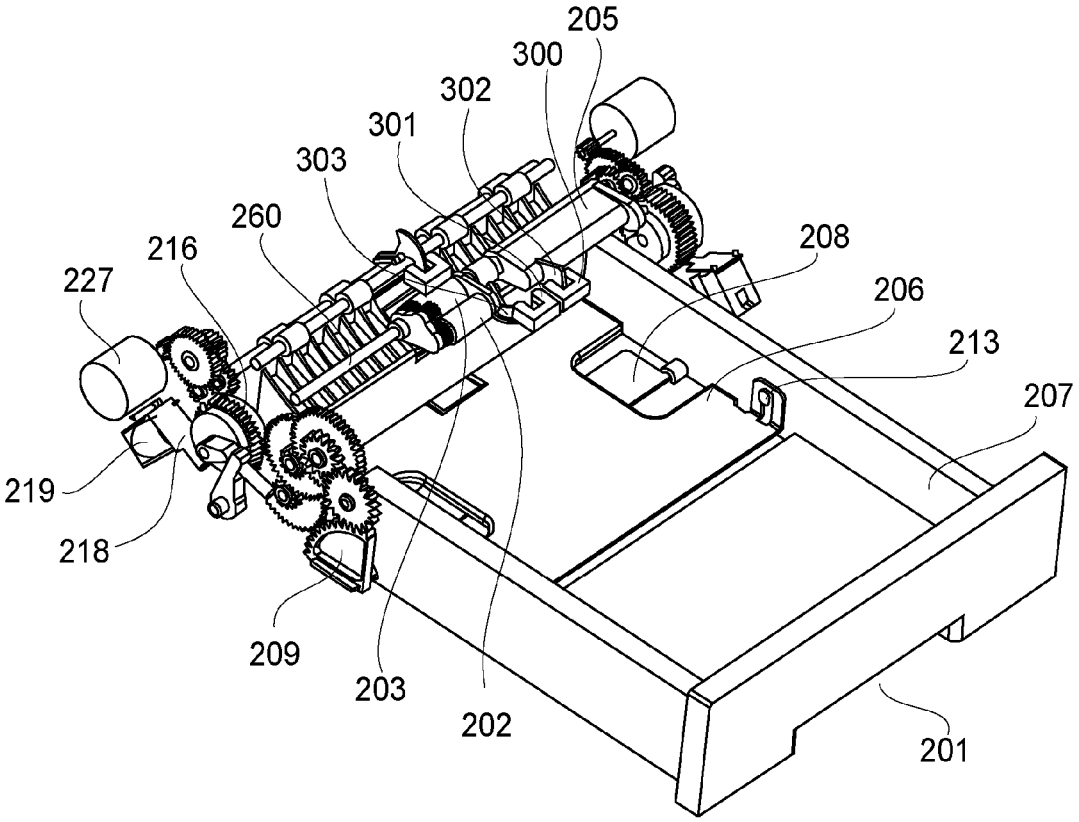
FIGS. 2A and 2B are perspective views each showing an outer appearance of a sheet feeding device in Embodiments 1-3.
Figure 2B:
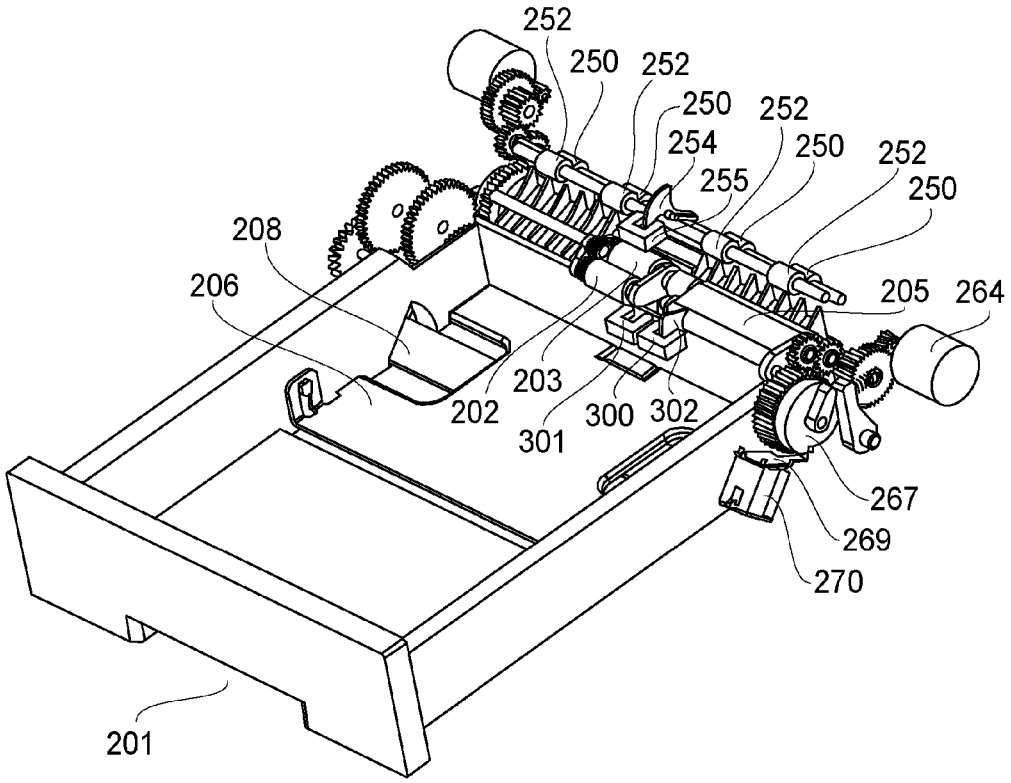

FIGS. 2A and 2B are perspective views each showing a structure of the sheet feeding device in this embodiment, wherein FIG. 2A is the perspective view when the sheet feeding device is seen from a lifter driving side (front side of FIG. 1A), and FIG. 2B is the perspective view when the sheet feeding device is seen from a sheet feeding (device) driving side (rear side of FIG. 1A).

(Sheet Feeding Type)

A sheet feeding type of the sheet feeding device in this embodiment is a retarding roller type using a counter rotating roller. In FIG. 2A, the sheet feeding roller 202 is supported by a supporting member 205 swingable in a vertical (up-down) direction about a rotation shaft of the feed roller 203. During the sheet feeding, the sheet feeding roller 202 is in a state in which the sheet feeding roller 202 contacts an uppermost surface of the sheets 8 stacked on the sheet stacking member 206 in the sheet feeding cassette ((b) of FIG. 4 described later). On the other hand, during non-sheet feeding, the sheet feeding roller 202 is in a state in which the sheet feeding roller 202 retracts from the uppermost surface of the sheets 8 stacked on the sheet stacking member 206 in an upward direction ((a) of FIG. 4 described later).

In FIG. 2B, in the case where the sheet is fed from the sheet feeding cassette 201, the sheet feeding controller 416 effects the following control. That is, the sheet feeding controller 416 applies a voltage to the solenoid 270 (i.e., turns on the solenoid 270), whereby prevention by a rotation preventing member 269 which prevents rotation of a sheet feeding partly tooth-omitted gear 267 is eliminated. As a result, the sheet feeding partly tooth-omitted gear 267 is in a rotatable state. As a result, the supporting member 205 rotates together with the sheet feeding roller 202 in a downward direction about the rotation shaft of the feed roller 203, so that a driving force is transmitted to downstream gears connected with the sheet feeding partly tooth-omitted gar 267 and thus the feed roller 203 is rotated. By a rotational operation of the supporting member 205, the sheet feeding roller 202 contacts the uppermost surface of the sheets 8 stacked on the sheet stacking member 206 and feeds the sheet 8 to a roller pair consisting of the feed roller 203 and the retarding roller 204. When the feeding of one sheet 8 is ended, the sheet feeding roller 202 is retracted in an upward direction in the figure until a sheet feeding operation of a subsequent sheet 8 is performed. Further, the retarding roller 204 is a counter rotating roller rotating in an opposite direction to the rotational direction of the feed roller 203, and a driving shaft of the retarding roller 204 is provided with a torque limiter (not shown). To the sheet feeding roller 202, the feed roller 203 and the retarding roller 204, the driving force from a driving motor 264 as a driving source described later, so that these rollers are rotationally driven.

(Sheet Separation by Retarding Roller Type)

Next, a sheet separating operation of the sheet feeding device of a retarding roller type in this embodiment will be described. As described above, by the rotation of the sheet feeding roller 202, the uppermost sheet 8 of the sheets stacked on the sheet stacking member 206 is fed to the roller pair consisting of the feed roller 203 and the retarding roller 204. At this time, in the case where only one of the sheets 8 is fed, the retarding roller 204 forms a nip in cooperation with the feed roller 203, and therefore a large rotational torque is exerted on the retarding roller 204 via the sheet 8 in an opposite direction to the rotational direction of the retarding roller 204. As a result, torque transmission is disconnected by the torque limiter, so that the retarding roller 204 is in an idling state. As a result, the during force from the driving motor 264 is not transmitted to the retarding roller 204, so that the retarding roller 204 is rotated by the fed sheet 8.

On the other hand, in the case where two or more sheets 8 are fed to between the feed roller 203 and the retarding roller 204, only a frictional force between the sheets is transmitted to the retarding roller 204 and the rotational torque of the feed roller 204 via the sheets is not transmitted to the retarding roller 204. For that reason, the torque limiter of the retarding roller 204 does not operate, so that the driving force from the driving motor 264 is transmitted to the retarding roller 204. As a result, the retarding roller 204 is rotated in the opposite direction to the rotational direction of the feed roller 203 and all of the sheets 8 except for the uppermost sheet 8 contacting the feed roller 203 are fed in an opposite direction to an original feeding direction, so that the sheets 8 are to be returned onto the sheet stacking member 206. In this way, by the reverse rotation of the retarding roller 204, the sheets 8 are separated one by one with reliability, so that the separated sheet 8 can be fed toward a feeding path downstream side.

(Manually Sheet Feeding Mechanism)

As shown in FIG. 1A, in the case where the sheet is manually fed, the sheet 8 is inserted through a manually sheet feeding opening provided at an upper portion of the sheet feeding cassette 201, so that the inserted sheet 8 is fed toward the sheet feeding roller 202 by manually feeding rollers 310*a*, 310*b*. The fed sheet 8 is further fed along a manually feeding guide 311 to the sheet feeding roller 202 by feeding rollers 310*c*, 310*d* and conveying rollers 310*e*, 310*f*. The thus-fed sheet 8 merges with a cassette sheet feeding path used when the sheet 8 is fed from the sheet feeding cassette 201, in front of the sheet feeding roller 202, and then similarly as in the case of the sheet feeding from the sheet feeding cassette 201, the sheet 8 is fed to the roller pair consisting of the feed roller 203 and the retarding roller 204 by the sheet feeding roller 202.

(Lifter Mechanism)

As shown in FIG. 2A, the sheet feeding cassette 201 includes a cassette frame 207, the swingable sheet stacking member 206 mounted to the cassette frame 207, and a lift arm 208 which is a raising and lowering portion for raising and lowering the sheet stacking member 206. The sheet feeding cassette 201 is inserted into the main assembly 101 from a right direction of FIG. 1A, and thus is mounted in the main assembly 101.

In the case where the sheet stacking member 206 is raised and lowered, the lifter controller 417 applies the voltage to the solenoid 219, whereby the prevention by the preventing member 218 which prevents the rotation of the partly tooth-omitted gear 216 is eliminated. As a result, the partly tooth-omitted gear 216 is in a rotatable state. As a result, a rotational driving force of the driving motor 227 is transmitted to the downstream gears connected with the partly tooth-omitted gear 216, so that when a lift arm driving gear 209 is rotated, also the lift arm 208 is similarly rotated and thus the sheet stacking member 206 on which the sheets 8 are stacked is rotated about a rotation shaft 213.

[Operation of Sheet Feeding Device]

(Operation During Mounting of Sheet Feeding Cassette)

Figure 3:
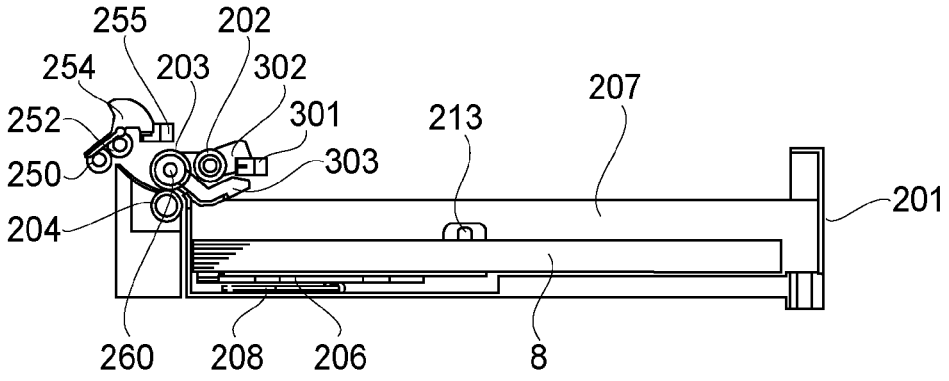
In FIG. 3, (a) and (b) are sectional views of the sheet feeding device in Embodiments 1-3.
Figure 3:
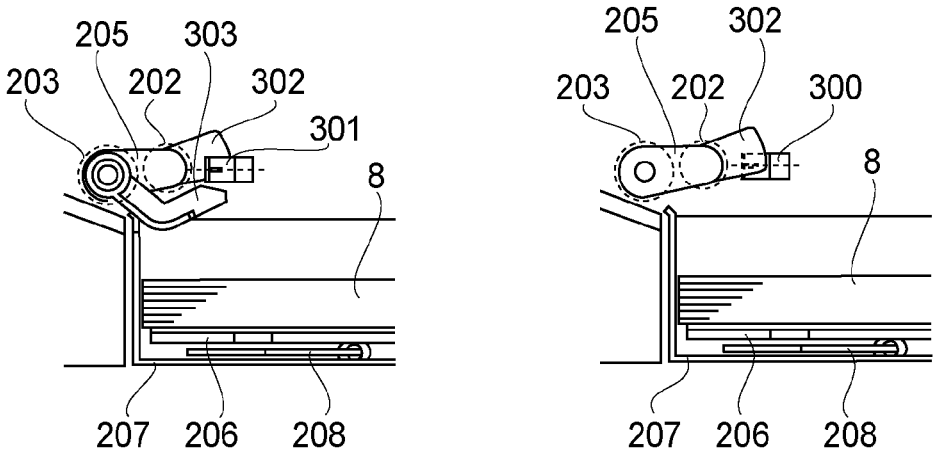

In FIG. 3, (a) is a sectional view, of the sheet feeding device, showing a state in which the sheet feeding cassette 201 in a state in which the sheets 8 are stacked is mounted in the main assembly 101. In FIG. 3, (a) shows a state in which a raising and lowering operation of the sheet stacking member 206 by the lifter controller 417 is not performed.

A sensor 300 as a second detecting portion detects a position (height) of the sheet feeding roller 202, i.e., detects whether or not the sheet feeding roller 202 is in a (feedable) position where the sheet feeding roller 202 is capable of feeding the uppermost sheet 8 of the sheets stacked on the sheet stacking member 206. The sensor 300 is a photo-sensor including a light-emitting portion and a light-receiving portion at a central portion (broken-line position) as shown on a right side of (b) of FIG. 3, light from the light-emitting portion is blocked or transmitted depending on the position (height) of a detection flag 302 provided on the supporting member 205. The sensor 300 outputs a detection signal so that an output of the detection signal is in an ON state when the light from the light-emitting portion is in a light-blocking state and is in an OFF state when the light from the light-emitting portion is in a (light) transmission state. Incidentally, the detection flag 302 raises and lowers (in synchronism) with the raising and lowering operation of the sheet feeding roller 202.

Further, a sensor 301 as a first detecting portion detects a position (height) of an uppermost surface of the sheets 8 stacked on the sheet stacking member 206 i.e., detects whether or not a sheet surface of the uppermost sheet 8 is in a sheet feeding position (feeding position). In the case where the lift arm 208 rotates and raises the sheets 8 stacked on the sheet stacking member 206, the detection flag 303 is pushed up by the sheets 8 stacked on the sheet stacking member 206, so that the detection flag 303 is rotated about a feed roller shaft 260. At this time, the detection flag 303 contacts the uppermost surface of the sheets 8. The sensor 301 is a photo-sensor including a light-emitting portion and a light-receiving portion at a central portion (broken-line position) as shown on a left side of (b) of FIG. 3, light from the light-emitting portion is blocked or transmitted depending on the position (height) of a detection flag 303. The sensor 301 outputs a detection signal so that an output of the detection signal is in an ON state when the light from the light-emitting portion is in a light-blocking state and is in an OFF state when the light from the light-emitting portion is in a (light) transmission state.

In FIG. 3, (b) is a sectional view, of the sheet feeding device, showing the detection flag 303 (left side of (b) of FIG. 3) and the detection flag 302 (right side of (b) of FIG. 3) when the sheet feeding cassette 201 placed in the state in which the sheets 8 are stacked is mounted in the main assembly 101. On the left side of (b) of FIG. 3, in a state in which the sheet feeding roller 202 is retracted in an upward direction in the figure, the detection flag 302 puts the output of the detection signal of the sensor 300 in the ON state (light-blocking state). On the other hand, on the left side of (b) of FIG. 3, the detection flag 303 lowers in a downward direction in the figure by its own weight, so that the output of the detection signal of the sensor 301 is in the OFF state (transmission state).

(Sheet Feeding Operation of Sheet which does not Curl)

Figure 4:
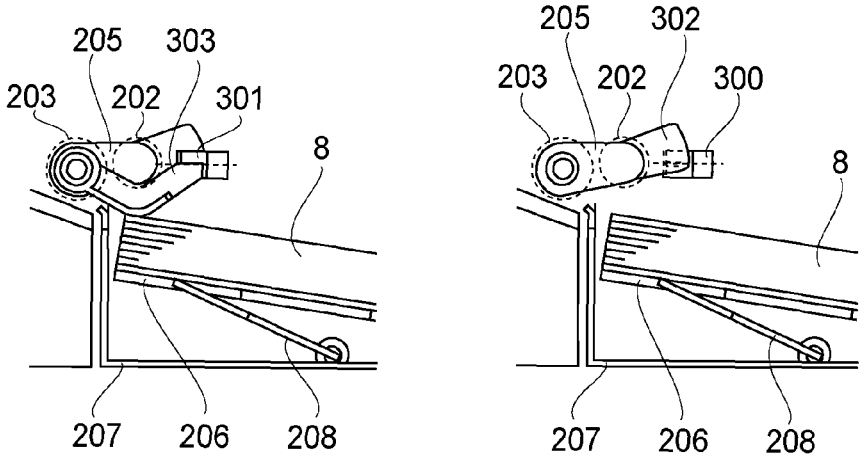
In FIG. 4, (a) is a sectional view showing an initial lift-up state in Embodiments 1-3, and (b) is a sectional view showing a state during a sheet feeding operation in Embodiments 1-3.
Figure 4:
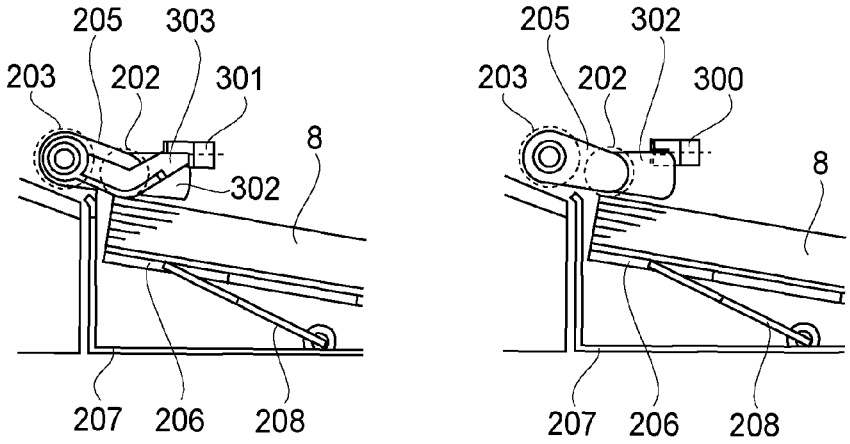

In FIG. 4, (a) is a sectional view showing a state in which the sheet feeding cassette 201 is changed from the state of FIG. 3 in which the sheet feeding cassette 201 is mounted in the main assembly 101 to a (sheet) feedable state by raising the sheet stacking member 206 (initial lift-up). In (a) of FIG. 4, a state of the sensor 301 and the detection flag 303 is shown on a left side, and a state of the sensor 300 and the detection flag 302 is shown on a right side. As described above, the CPU 411 eliminates the prevention of the partly tooth-omitted gear 216 by driving the solenoid 219 through the lifter controller 417, so that the driving force of the driving motor 227 is transmitted and the lift arm 208 is rotated, and thus the sheet stacking member 206 is raised. By the raising of the sheet stacking member 206, the uppermost surface of the sheets 8 stacked on the sheet stacking member 206 pushes up the detection flag 303. As a result, by a change in state of the sensor 301 from the transmission state to the light-blocking state by the detection flag 303, the output of the detection signal of the sensor 301 is changed from the OFF state to the ON state. When the output of the detection signal of the sensor 301 is in the ON state, the CPU 411 discriminates that the sheet feeding cassette 201 is in the state in which the sheets 8 on the sheet stacking member 206 are feedable, and controls the lifter controller 417 and stops drive of the driving motor 227 and the solenoid 219.

(Control Sequence of Initial Lift-Up Operation)

Figure 5:
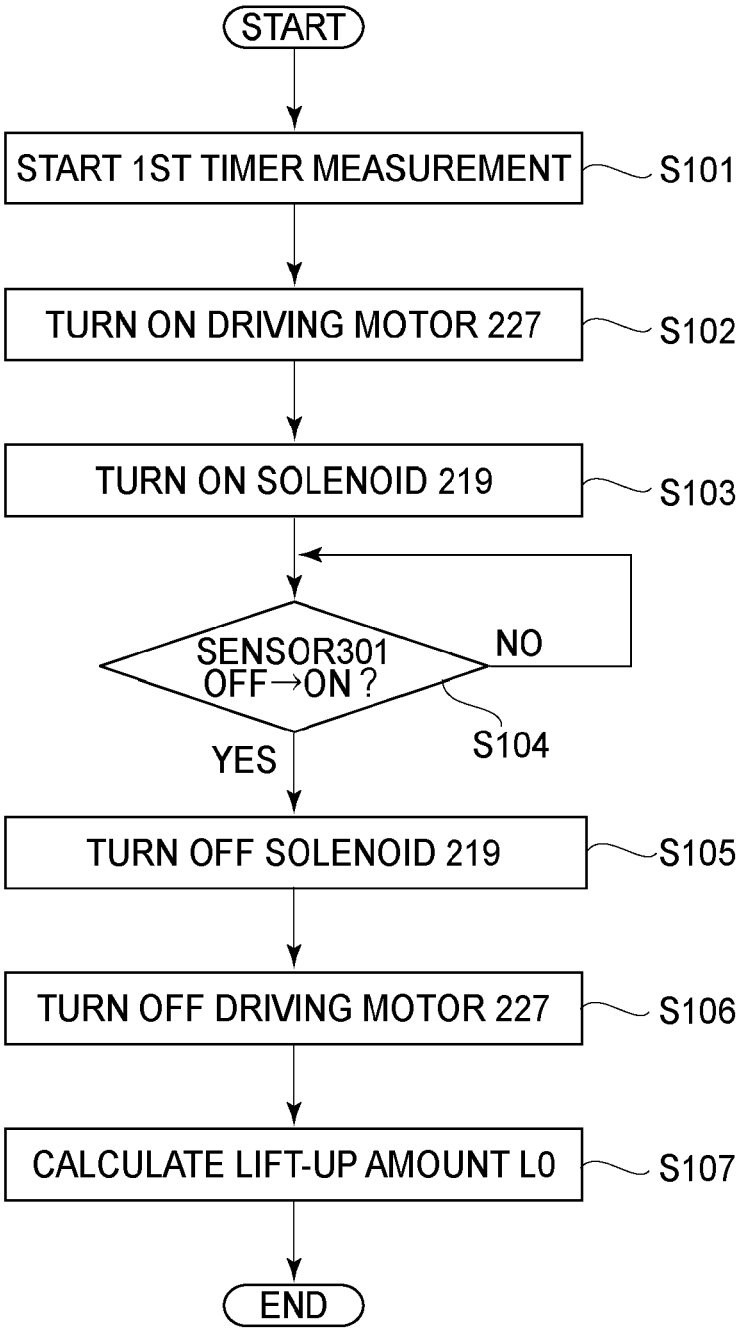
FIG. 5 is a flow chart showing a control sequence of an initial lift-up in Embodiments 1-3.

FIG. 5 is a flowchart showing a control sequence when the initial lift-up is carried out after the sheet feeding cassette 201 is mounted in the main assembly 101. A process shown in FIG. 5 is carried out by the CPU 411 by actuating the sheet feeding device after the sheet feeding cassette 201 is mounted in the main assembly 101. In Step S101, in order to measure an initial lift-up amount of the sheet stacking member 206, the CPU 411 resets a first time and then starts the first time, so that time measurement is started. In S102, the CPU 411 drives (i.e., turns on) the driving motor 227 through the lifter controller 417. In S103, the CPU 411 drives (i.e., turns on) the solenoid 219 through the lifter controller 417. As a result, the prevention of rotation of the partly tooth-omitted gear 216 is eliminated and the rotational driving force of the driving motor 227 is transmitted to the lift arm driving gear 209, so that the lift arm 208 is rotated and thus the sheet stacking member 206 is raised.

In S104, in order to discriminate whether or not the sheets 8 stacked on the sheet stacking member 206 are raised to a predetermined feedable height (position), the CPU 411 monitors the state of the output signal of the sensor 301 through the lifter controller 417. That is, the CPU 411 discriminates that the sheet stacking member 206 is not raised to the predetermined height when the OFF state (transmission state) of the sensor 301 is detected, and then repeats a process of S104. The CPU 411 discriminates that the sheet stacking member 206 was raised to the predetermined height when the ON state (light-blocking state) of the sensor 301, and then stops the time measurement by the first time, so that the sequence goes to a process of S105.

In S105, the CPU 411 stops the drive of the solenoid 219 through the lifter controller 417 (i.e., turns off the solenoid 219). As a result, rotation prevention of the partly tooth-omitted gear 216 is set by the preventing member 218, so that the rotational driving force of the driving motor 227 is not transmitted to the lift arm driving gear 209. In S106, the CPU 411 stops the drive of the driving motor 227 through the lifter controller 417 (i.e., turns off the driving motor 227). In S107, the CPU 411 makes reference to a time value of the first time and calculates an initial lift-up amount L0 which is a raising amount in which the sheet stacking member 206 was lifted up, and then stores the initial lift-up amount L0 in the RAM 411*b*.

Incidentally, the initial lift-up amount L0 which is a fourth correction amount can be calculated by the following formula (1).

$$L0\ (\text{mm}) = r0\ (\text{mm}) \times \omega 0\ (\text{rad/sec}) \times T0\ (\text{sec}) \quad (1)$$

Here, a length r0 (unit: mm) represents a length of an arm portion of the lift arm 208 (length from a rotation center (axis) to a connecting portion to the sheet stacking member 206). An angular velocity ω0 (unit: rad/sec) is a predetermined angular velocity at which the lift arm 208 is driven, and a time T0 represents an elapsed time measured by the first time. Each of the length r0 and the angular velocity ω0 is fixed value and is stored in the ROM 411*a* in advance, the CPU 411 reads out these values from the ROM 411*a* when the CPU 411 calculates the initial lift-up amount L0.

(Sheet Feeding of Sheet which does not Curl)

In FIG. 4, (b) is a sectional view showing a state in which the sheet feeding operation of the sheet 8 is performed after the sheet feeding cassette 201 is placed in the sheet feedable state of the sheets 8 ((a) of FIG. 4). In (b) of FIG. 4, a state of the sensor 301 and the detection flag 303 is shown on a left side, and a state of the sensor 300 and the detection flag 302 is shown on a right side. From the state shown in (a) of FIG. 4, the CPU 411 drives the driving motor 264 through the sheet feeding controller 416 and turns on the solenoid 270 for a predetermined time. As a result, the prevention of rotation by the rotation preventing member 269 is eliminated and the sheet feeding partly tooth-omitted gear 267 is in a rotatable state, so that the supporting member 205 rotates together with the sheet feeding roller 202 in the downward direction. By the rotational operation of the supporting member 205, the sheet feeding roller 202 contacts the uppermost surface of the sheets 8 stacked on the sheet stacking member 206, so that the sheet feeding operation for feeding the sheet 8 to the roller pair consisting of the feed roller 203 and the retarding roller 204.

As shown in (b) of FIG. 4, when the sheet feeding roller 202 contacts the sheet 8 and the detection signal of the sensor 300 is in the ON state (light-blocking state), the sheet feeding operation is performed. Then, the fed sheet 8 is fed to the nip between the feed roller 203 and the retarding roller 204 and is further fed to the nip between the conveying roller 250 and the conveying opposite roller 252. In the neighborhood of the conveying roller 250 and the conveying opposite roller 252, a conveyance (feeding) sensor 255 is provided in order to detect whether or not feeding of the sheet 8 is normally performed ((a) of FIG. 3). The conveyance sensor 255 is a photo-sensor including a light-emitting portion and a light-receiving portion at a central portion, and light from the light-emitting portion is blocked or transmitted by a conveyance (feeding) detection flag 254 provided in the feeding nip between the conveying roller 250 and the conveying opposite roller 252. The conveyance detection flag 254 is rotated when the fed sheet 8 passes through the feeding nip, so that at the conveyance sensor 255, the light from the light-emitting portion is changed from the transmission state to the light-blocking state, and thus the output of the detection signal is changed from the OFF state (light-blocking state) to the ON state (transmission state). Depending on the detection signal outputted from the conveyance sensor 255, the CPU 411 can detect whether or not the feeding of the sheet 8 is normally performed, and on the basis of the detection signal of the conveyance sensor 255, the printing operation is continued.

Further, every sheet feeding of the sheet 8, a position of the uppermost surface of the sheets 8 stacked on the sheet stacking member 206 lowers. Then, also a position of the sheet feeding roller 202 contacting the uppermost sheet 8 gradually lowers and correspondingly, also a position of the detection flag 302 lowers, and then the detection signal of the sensor 300 changes from the ON state (light-blocking state) to the OFF state (transmission state). In that case, the CPU 411 drives the driving motor 227 and the solenoid 219 through the lifter controller 417, so that the lift arm 208 is rotated and thus the sheet stacking member 206 is raised by a predetermined life-up amount L1 (mm) (additional lift-up). Incidentally, the life-up amount L1 of the addition lift-up is a predetermined value and is stored in the ROM 411*a*. During the additional lift-up, the CPU 411 rotates the lift arm 208 for a predetermined time, so that the sheet stacking member 206 is raised by the life-up amount L1 (mm).

(Sheet Feeding of Curled Sheet)

Figure 6:
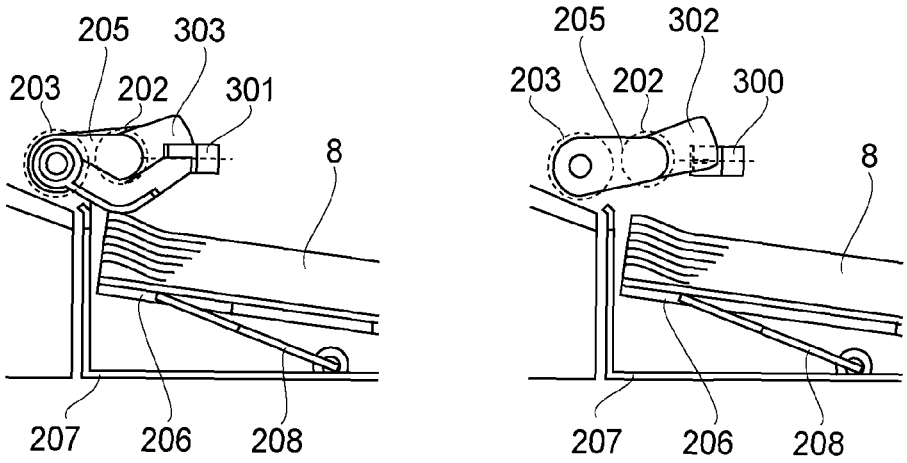
In FIG. 6, (a) is a sectional view showing an initial lift-up state in Embodiments 1-3, and (b) is a sectional view showing a state during a sheet feeding operation in Embodiments 1-3.
Figure 6:
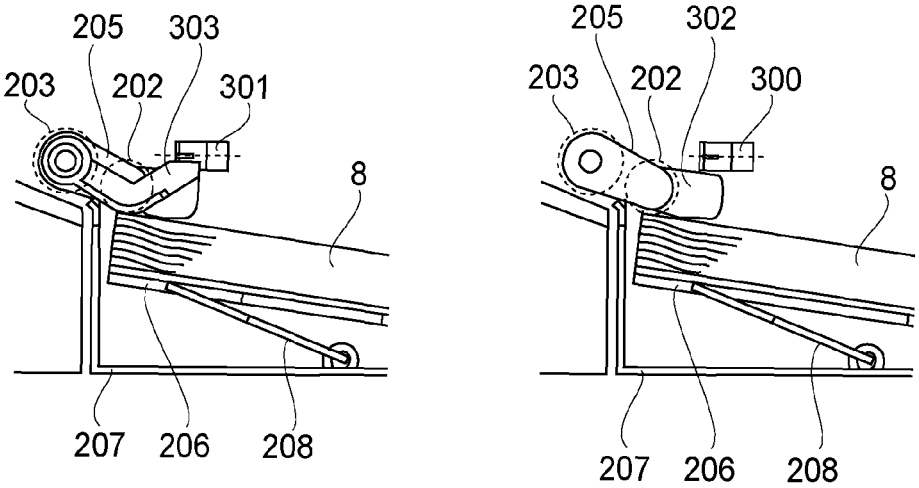

Next, sheet feeding of the sheet 8 in a state in which an end portion of the sheet 8 is curled with respect to the feeding direction of the sheets 8 stacked on the sheet stacking member 206 will be described. In FIG. 6, (a) is a sectional view showing a change in state of the sheet feeding cassette 201 in which sheets 8 curled at their fee end portions with respect to the feeding direction are stacked on the sheet stacking member 206 from a state in which the sheet feeding cassette 201 is mounted in the main assembly 101 to a sheet feedable state of the sheets 8 by the raising of the sheet stacking member 206 by the execution of the initial lift-up.

In (a) of FIG. 6, a state of the sensor 301 and the detection flag 302 is shown on a left side, and a state of the sensor 300 and the detection flag 302 is shown on a right side. Similarly as in (a) of FIG. 4 showing the states of the sheets 8 of which free end portions with respect to the feeding direction are not curled, the CPU 411 drives the driving motor 227 and the solenoid 219 by the initial lift-up process, so that the sheet stacking member 206 is raised. By this process, the uppermost surface of the sheets 8 stacked on the sheet stacking member 206 pushes up the detection flag 303, and the CPU 411 stops the drives of the driving motor 227 and the solenoid 219 at timing when the detection signal of the sensor 301 was in the ON state.

In FIG. 6, (b) is a sectional view showing a state in which the sheet feeding operation of the sheet 8 is performed after the sheet feeding cassette 201 is placed in the sheet feedable state of the sheets 8 ((a) of FIG. 6). In (b) of FIG. 6, a state of the sensor 301 and the detection flag 303 is shown on a left side, and a state of the sensor 300 and the detection flag 302 is shown on a right side. From the state shown in (a) of FIG. 6, the CPU 411 drives the driving motor 264 through the sheet feeding controller 416 and turns on the solenoid 270 for a predetermined time. As a result, the supporting member 205 rotates together with the sheet feeding roller 202 in the downward direction. By the rotational operation of the supporting member 205, the sheet feeding roller 202 contacts the uppermost surface of the sheets 8 stacked on the sheet stacking member 206, so that the sheet feeding operation for feeding the sheet 8 to the roller pair consisting of the feed roller 203 and the retarding roller 204.

In this case, the free end portions of the sheets 8 are curled, and therefore, the sheet feeding roller 202 is press-contacted to the uppermost sheet 8 and lowers while pressing and closing a gap between sheets 8 and a gap between the sheet 8 and the sheet stacking member 206, so that a curled state of the sheets 8 is corrected. As a result, the sheet feeding roller 202 performs the sheet feeding operation at a position relatively lower than the position shown in (b) of FIG. 4 described above. Then, during the sheet feeding operation, also the detection flag 302 lowers together with the sheet feeding roller 202, with the result that the detection signal of the sensor 300 which is the photo-sensor changes in state from the ON state (light-blocking state) to the OFF state (transmission state). Further, the sheet feeding roller 202 lowers while pressing the curled portion of the sheets 8, and therefore also the detection flag 303 lowers together with the uppermost sheet 8 of the sheets stacked on the sheet stacking member 206. As a result, also the detection signal of the sensor 301 changes in state from the ON state (light-blocking state) to the OFF state (transmission state). The sheet feeding device in this embodiment employs a constitution in which the detection signal of the sensor 301 changes in state from the ON state (light-blocking state) to the OFF state (transmission state) after the detection signal of the sensor 300 changes in state from the ON state (light-blocking state) to the OFF state (transmission state). When the sheet feeding operation is performed in a state in which the position of the uppermost surface of the sheets 8 stacked on the sheet stacking member 206 excessively lowers, the free end portions of the sheets 8 contact the cassette frame 207. As a result, there arises a possibility that feeding timing of the sheet 8 is delayed and that the sheet 8 cannot be fed to the roller pair consisting of the feed roller 203 and the retarding roller 204 and thus a jam occurs.

[Timing Chart During Sheet Feeding Operation]

Figure 7:
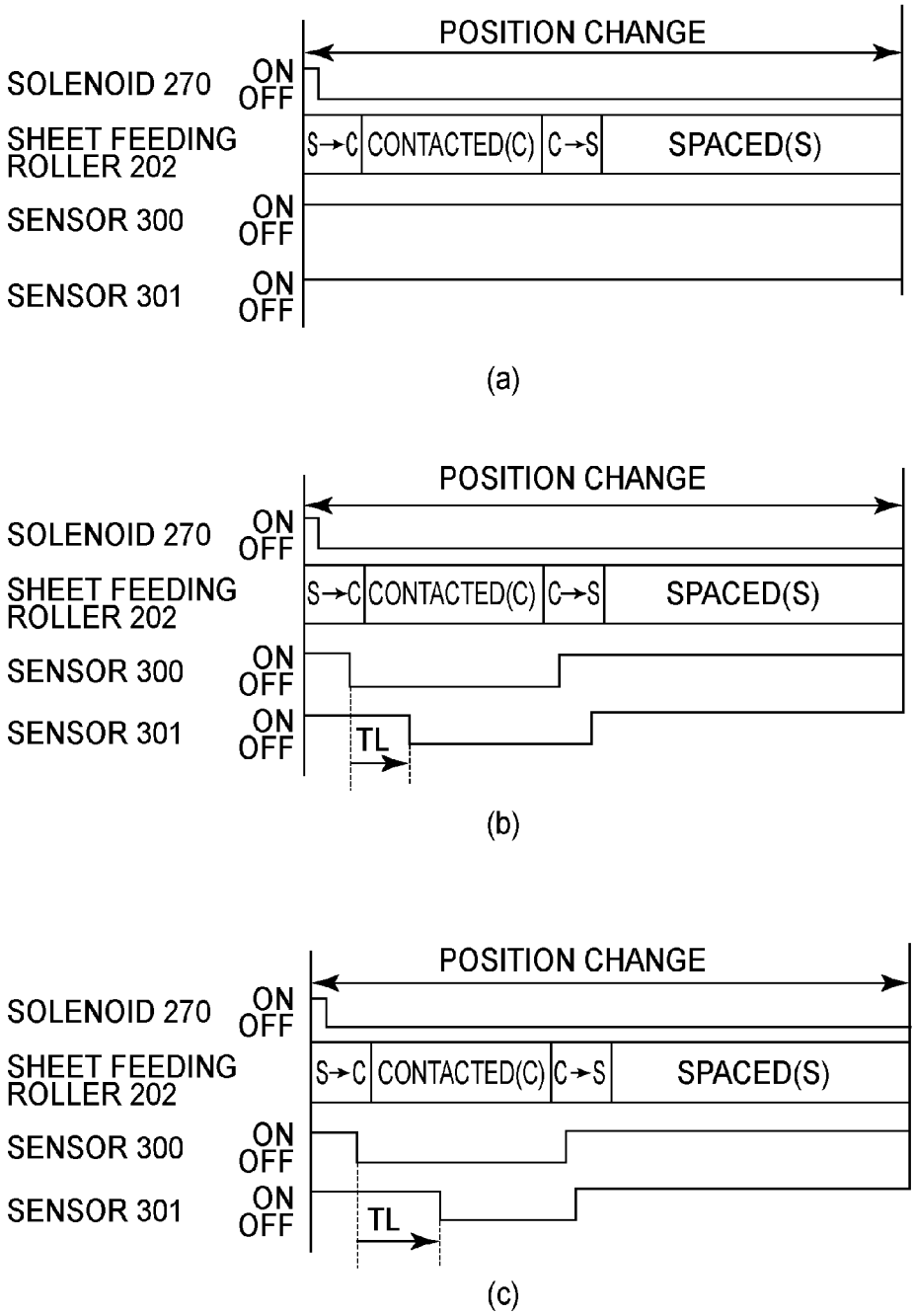
In FIG. 7, (a) to (c) are timing charts of the sheet feeding operation of the sheet feeding device in Embodiment 1.

In FIG. 7, (a) to (c) are timing charts each illustrating changes in states of the solenoid 270, the sheet feeding roller 202, the sensor 300 and the sensor 301 when the sheet feeding operation by the sheet feeding roller 202 is carried out. In (a) to (c) of FIG. 7, depending on a curled amount of the sheet 8, output states (ON state and OFF state) of the detection signals of the sensor 300 and the sensor 301 are different. In FIG. 7, (a) shows a timing chart showing the sheet feeding operation ((b) of FIG. 4) after the initial lift-up of the sheet 8 which is not curled, and each of (b) and (c) shows a timing chart when the sheet feeding operation ((b) of FIG. 6) of the sheet 8 which is curled at its free end portions is performed. A difference between (b) of FIG. 7 and (c) of FIG. 7 is that the curled amount of the sheet 8 in (c) of FIG. 7 is larger than the curled amount of the sheet 8 in (b) of FIG. 7.

In FIG. 7, (a) is the timing chart showing a change in sheet feeding operation (sheet feeding operation 1 position) for feeding one (single) sheet 8 by the sheet feeding roller 202, and the sheet feeding operation of the sheet 8 by the sheet feeding roller 202 is performed in the following manner. That is, by turning on the solenoid 270, the sheet feeding roller 202 is controlled so that the sheet feeding roller 202 is lowered from a state (spaced state) in which the sheet feeding roller 202 is retracted in the upward direction toward the sheets 8 stacked on the sheet stacking member 206, so that the sheet feeding roller 202 is contacted to the uppermost sheet 8 ("SPACED (S)" to "CONTACTED (C)"). The sheet feeding roller 202 is rotationally driven by the driving motor 264 and when the sheet feeding roller 202 is contacted to the uppermost sheet 8, the sheet feeding roller 202 feeds the sheet 8 to the roller pair consisting of the feed roller 203 and the retarding roller 204 ("CONTACTED (C)". When the feeding of one sheet 8 (uppermost sheet 8) is ended, the sheet feeding roller 202 is controlled so as to be raised toward a retracted position, so that the sheet feeding roller 202 is spaced from the sheets 8 stacked on the sheet stacking member 206 ("CONTACTED (C)" to "SPACED (S)". The sheet feeding roller 202 moved to the retracted position is on stand-by at the retracted position until the solenoid 270 is turned on again.

In FIG. 7, (a) is the timing chart the sheet feeding of the sheet 8 which is not curled at its free end portion with respect to the feeding direction. In the case of (a) of FIG. 7, the gaps due to the curl are not formed between the sheets 8 and between the sheet 8 and the sheet stacking member 206, and therefore even when the sheets 8 stacked on the sheet stacking member 206 are press-contacted by the sheet feeding roller 202, the position of the uppermost sheet 8 is unchanged. For that reason, when the sheet feeding operation for feeding one sheet 8 is performed by the sheet feeding roller 202, both of the sensor 300 and the sensor 301 are maintained in the ON state (light-blocking state). That is, the light-receiving portion of the sensor 300 which is the photo-sensor is in a state in which the light from the light-emitting portion is blocked by the detection flag 302. Also as regards the sensor 301 which is the photo-sensor, similarly, the light-receiving portion of the sensor 301 is in a state in which the light from the light-emitting portion is blocked by the detection flag 303.

In FIG. 7, (b) is the timing chart when the sheet feeding of the sheet 8 which is curled at its free end portion with respect to the feeding direction is performed. The sheet feeding operation by the sheet feeding roller 202 is similar to that in the case of (a) of FIG. 7, and therefore will be omitted from illustration. In the case of (b) of FIG. 7, the gaps due to the curl are formed between the sheets 8 and between the sheet 8 and the sheet stacking member 206. For that reason, the sheets 8 stacked on the sheet stacking member 206 are press-contacted by the sheet feeding roller 202, whereby the gaps due to the curl are pressed and closed and correspondingly, the position of the uppermost sheet 8 gradually lowers in the downward direction (direction toward the bottom of the sheet feeding cassette 201). As a result, also the detection flag 302 for detecting the position (height) of the sheet 8 to which the sheet feeding roller 202 is contacted lowers in the downward direction, so that the detection signal of the sensor 300 changes in state from the ON state (light-blocking state by the detection flag 302 to the OFF state (transmission state).

Thereafter, the free end portion of the sheet 8 with respect to the feeding direction is curled, and therefore the sheet feeding roller 202 gradually lowers while pressing and closing the gaps formed due to the curl, whereby also the position of the detection flag 303 contacting the uppermost sheet 8 gradually lowers. As a result, also the detection flag 303 for detecting the position (height) of the uppermost sheet 8 of the sheets 8 stacked on the sheet stacking member 206 lowers in the downward direction, so that the detection signal of the sensor 301 changes in state from the ON state (light-blocking state by the detection flag 303 to the OFF state (transmission state).

In order to move the sheet feeding roller 202 to the retracted position, when control for raising the sheet feeding roller 202 toward the retracted position is effected, the sheets 8 stacked on the sheet stacking member 206 are free from the urging by the sheet feeding roller 202, and therefore the state of the sheets 8 are returned to the original curled state. As a result, also the position of the detection flag 303 contacting the uppermost sheet 8. As a result, the detection signal of the sensor 301 changes in state from the OFF state (in which the light is not blocked by the detection flag 303) to the ON state (in which the light is blocked by the detection flag 303). Further, also the detection flag 302 is raised together with the raising of the sheet feeding roller 202, and therefore also the sensor 300 changes in state from the OFF state 8 transmission state) to the ON state (light-blocking state) similarly as in the case of the sensor 301.

In FIG. 7, (c) is the timing chart, similar to that of (b) of FIG. 7, when the sheet feeding of the sheet 8 which is curled at its free end portion with respect to the feeding direction is performed. In FIG. 7, (c) is the timing chart in the case where the curled amount of the sheet 8 is larger than the curled amount in the case of (b) of FIG. 7, but the sheet feeding operation by the sheet feeding roller 202 and the changes in states of the sensor 300 and the sensor 301 are similar to those in the case of (b) of FIG. 7, and therefore will be omitted from description. In (c) of FIG. 7, compared with the case of (b) of FIG. 7, a time until the state of the sensor 301 changes from the ON state to the OFF state is long, but there is because the curled amount of the sheet 8 is large compared with that in the case of (b) of FIG. 7. A large amount in which the gaps are pressed and closed by the sheet feeding roller 202 means that the position of the uppermost surface of the sheets 8 is lower than that at the time of start of the sheet feeding operation, and therefore a larger life-up amount is needed.

A time TL shown in each of (b) and (c) of FIG. 7 represents a time from a change in state of the sensor 300 from the ON state to the OFF state to a change in state of the sensor 301 from the ON state to the OFF state. The time TL varies depending on an amount in which the sheet feeding roller 202 physically process the uppermost surface of the sheets 8 and presses and closes the gaps (i.e., an amount in which the position of the uppermost surface of the sheets 8 is lowered). For example, between (b) of FIG. 7 and (c) of FIG. 7, the curled amount of the free end portion of the sheet 8 with respect to the feeding direction is different, and the curled amount is larger in (c) of FIG. 7 than in (b) of FIG. 7, and therefore the time TL is long correspondingly thereto.

A feature of the present invention is such that a life-up amount L2, to be added, of the sheet stacking member 206 is determined depending on the time TL and the lift-up is carried out and thus the height of the uppermost surface of the sheets 8 stacked on the sheet stacking member 206 during the sheet feeding operation is maintained at a predetermined height. The life-up amount L2 (mm) to be added is a raising amount of a free end portion of the sheet stacking member 206, and the CPU 411 drives the driving motor 227 and the solenoid 219 through the lifter controller 417, so that the sheet stacking member 206 is lifted up correspondingly to the life-up amount L2.

The life-up amount L2 as a first correction amount corresponds to an amount in which the position of the uppermost surface of the sheets 8 stacked on the sheet stacking member 206 is lowered by the urging by the sheet feeding roller 202. Therefore, the life-up amount L2 can be approximately obtained by the following formula (2).

$$L2\ (\text{mm}) = r1\ (\text{mm}) \times \omega 1\ (\text{rad/sec}) \times TL\ (msec)/1000 + B\ (\text{mm}) \qquad (2)$$

In the formula (2), a length r1 (unit: mm) represents a length from a rotation center (axis) of the detection flag 302 to an end portion on the sensor 300 side). An angular velocity ω1 (unit: rad/sec) is a predetermined angular velocity of the detection flag 302. Each of the length r1 and the angular velocity ω1 is fixed value and is stored in the ROM 411*a* in advance, the CPU 411 reads out these values from the ROM 411*a* when the CPU 411 calculates the lift-up amount L2. Accordingly, by (r1×ω1×TL/1000) in the formula (2), a distance in which the detection flag 302 lowers in a time from the change in state of the sensor 300 to the OFF state to the change in state of the sensor 301 to the OFF state is obtained. Further, B (unit: mm) which is a second correction amount is determined by a position (height) where the uppermost surface of the sheets 8 stacked on the sheet stacking member 208 is intended to be raised, i.e., a position (height) where the uppermost surface is intended to be further raised from the position where the sensor 300 changed in state from the OFF state to the ON state. In this manner, the sheet stacking member 206 is raised depending on the life-up amount L2 determined by the formula (2). As a result, as shown in (a) of FIG. 7, during the sheet feeding of the sheet 8, the position of the uppermost surface of the sheets 8 can be raised to the position where not only the sensor 300 but also the sensor 301 are not in the OFF state.

[Control Sequence of Sheet Feeding Operation]

Figure 8:
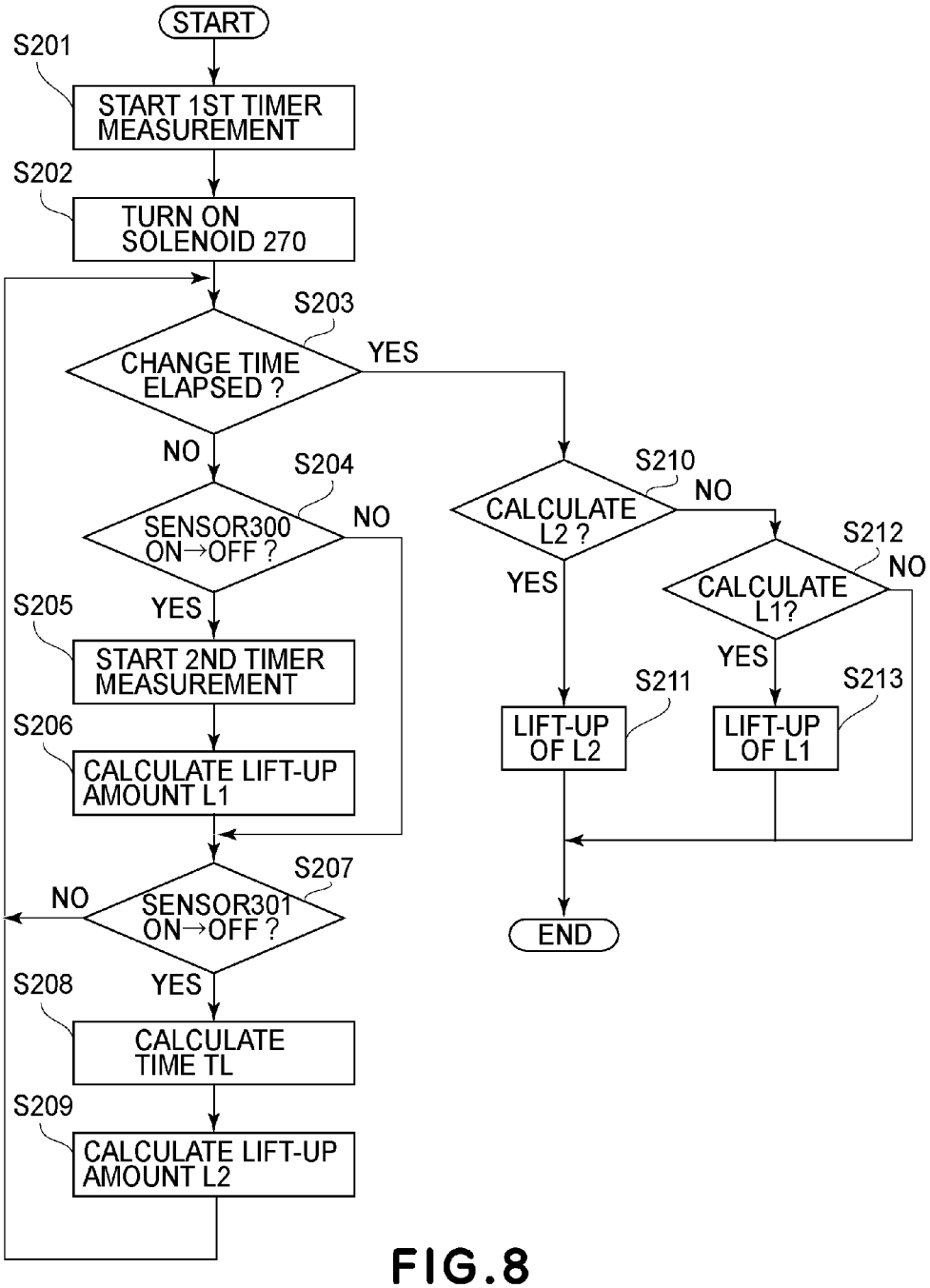
FIG. 8 is a flowchart showing a control sequence of the sheet feeding operation in Embodiment 1.

FIG. 8 is a flowchart showing a control sequence for determining the additional life-up amount depending on a degree of the curl of the sheet 8 when the sheet feeding operation is carried out. A process shown in FIG. 8 is started when the sheet feeding of the sheet 8 is performed, and is executed by the CPU 411. Incidentally, before the process of FIG. 8 is started, the initial lift-up operation of FIG. 5 described above has already been performed. Further, at the time when the process of FIG. 8 is started, the detection signals of the sensor 300 and the sensor 301 are in the ON state, i.e., the sensor 300 and the sensor 301 are in the light-blocking state by the detection flag 302 and the detection flag 303, respectively. In S201, the CPU 411 resets the first timer in order to measure a time required to perform the sheet feeding operation, and then starts the first time, and thus time measurement is started. In S202, the CPU 411 turns on the solenoid 270 for a predetermined time through the sheet feeding controller 416. As a result, the prevention of rotation by the rotation preventing member 269 is eliminated, so that the sheet feeding partly tooth-omitted gear 267 is in a rotatable state. As a result, the sheet feeding roller 202 contacts the uppermost surface of the sheets 8 stacked on the sheet stacking member 206, and then the sheet feeding operation for feeding the sheet 8 is performed, and after one sheet 8 is fed, the sheet feeding roller 202 is spaced from the sheet 8 and is returned to the retracted position. Such a series of processes is performed.

In S203, the CPU 411 makes reference to the first timer and discriminates whether or not a change time of a sheet feeding operation 1 position elapsed. In the case where the CPU 411 discriminated that the change time elapsed, the sequence goes to a process of S210, and in the case where the CPU 411 discriminated that the change time does not elapse, the sequence goes to a process of S204. In S204, the CPU 411 reads the state of the detection signal of the sensor 300 through the lifter controller 417, and discriminates whether or not the state of the detection signal changed from the ON state (light-blocking state by the detection flag 302) to the OFF state (transmission state). In the case where the CPU 411 discriminated that the detection signal state changed from the ON state to the OFF state, the sequence goes to a process of S205, and in the case where the CPU 411 discriminated that the detection signal state is unchanged while being kept in the ON state or the OFF state, the sequence goes to a process of S207. In S205, the CPU 411 resets a second timer and then starts the second timer, and thus time measurement is started. The second timer is used to measure a time from the change in state of the sensor 300 from the ON state (light-blocking state) to the OFF state 8 transmission state) to the change in state of the sensor 301 from the ON state (light-blocking state) to the OFF state (transmission state). In S206, the CPU 411 calculates the life-up amount L1, for additional lift-up, which is a third correction amount since the change in state of the sensor 300 from the ON state (light-blocking state) to the OFF state (transmission state) is detected and the above-described lift-up is needed. In this embodiment, the life-up amount L1 for the additional lift-up is a fixed value (predetermined amount), and therefore the CPU 411 reads the life-up amount L1 from the ROM 411*a* instead of the calculation of the life-up amount L1, and then stores the life-up amount L1 in the RAM 411*b*.

In S207, the CPU 411 reads the detection signal state of the sensor 301 and discriminates whether or not the detection signal state changed from the ON state (light-blocking state by the detection flag 303) to the OFF state (transmission state). In the case where the CPU 411 discriminated that the detection signal state changed from the ON state to the OFF state, the sequence goes to a process of S208, and in the case where the CPU 411 discriminated that the detection signal state is unchanged while being kept in the ON state or the OFF state, the sequence returns to the process of S203. In S208, the CPU 411 stops the second timer and makes reference to a timer value (elapsed time) of the second timer, and then calculates the time TL. In S209, the CPU 411 calculates the life-up amount L2, to be added, by the formula (2) described above and is stored in the RAM 411*b*.

In S210, the CPU 411 discriminated whether or not the life-up amount L2 was calculated. In the case where the CPU 411 processed that the life-up amount L2 was calculated, the sequence goes to a process of S211, and in the case where the CPU 411 discriminated that the life-up amount L2 was not calculated, the sequence goes to a process of S212. In S211, the CPU 411 carries out the lift-up in an amount corresponding to the life-up amount L2 through the lifter controller 417, and then ends the sequence. In S212, the CPU 411 discriminated whether or not the life-up amount L1 was calculated. In the case where the CPU 411 discriminated that the life-up amount L1 was calculated, the sequence goes to S213, and in the case where the CPU 411 discriminated that the life-up amount L1 was not calculated, the CPU 411 ends the sequence without effecting the additional lift-up. In S213, the CPU 411 effects the lift-up in an amount corresponding to the life-up amount L1 through the lifter controller 417 and ends the sequence.

The life-up amount of the sheet stacking member 206 is determined through the lifter controller 417 depending on a time in which the lift arm 208 is driven. That is, the life-up amount of the sheet stacking member 206 is, as described above, determined depending on the time in which the arm portion, of the lift arm 208, having the predetermined length r0 is driven at the predetermined angular velocity ω0. Therefore, in this embodiment, information by which the life-up amount of the sheet stacking member 206 and the drive time of the lift arm 208 are associated with each other is stored in the ROM 411*a*. Then, the CPU 411 reads the drive time of the lift arm 208 corresponding to a necessary life-up amount, and on the basis of the read drive time, drives the lift arm 208 through the lifter controller 417.

As described above, the life-up amount is determined depending on the states of the sensors 300 and 301, and therefore even when the sheets 8 are curled, the height of the uppermost surface of the sheets 8 stacked on the sheet stacking member 206 is adjusted to a height suitable for the sheet feeding operation. As a result, a stable sheet feeding operation can be performed.

As described above, according to this embodiment, even in the state in which the sheets are curled, the sheet can be stably fed. In this embodiment, the life-up amount L2, to be added, of the sheet stacking member 206 was determined depending on the time TL and then the lift-up was effected. As a result, the height of the uppermost surface of the sheets 8, stacked on the sheet stacking member 206, during the sheet feeding operation was able to be maintained at the predetermined height. Here, as in the cases of (b) of FIG. 7 and (c) of FIG. 7, when both of the sensors 300 and 301 changed in state from the ON state to the OFF state, also a method in which a uniform life-up amount is set and then the lift-up is carried out would be considered. In this case, when the uniform life-up amount is set to the life-up amount in the case of (b) of FIG. 7, the set life-up amount is insufficient in the case of (c) of FIG. 7, so that there is a possibility that the sheet 8 contacts the cassette frame 207. Therefore, when the uniform life-up amount is set to the life-up amount in the case of (c) of FIG. 7, the sheet 8 is lifted up to a position higher than the predetermined height in the case of (b) of FIG. 7. In this manner, in a state in which the position of the uppermost surface of the sheets 8 stacked on the sheet stacking member 206 is excessively high, when the sheet feeding operation is performed by the sheet feeding roller 202, the free end portion of the sheet 8 with respect to the feeding direction contacts the feed roller 203. As a result, there is a possibility that the feeding timing of the sheet 8 is delayed and that the sheet 8 cannot be fed to the roller pair consisting of the feed roller 203 and the retarding roller 204 and thus a jam occurs. Accordingly, there is a possibility that a problem generates when the life-up amount is excessively small or excessively large, so that setting of a proper life-up amount is important.

Embodiment 2

[Notification of Remaining Sheet Amount]

Of image forming apparatuses such as the image forming apparatus including the lift-up mechanism described in Embodiment 1, there is an image forming apparatus in which a remaining sheet amount of the sheet feeding cassette 201 is notified on the control panel 403 on the basis of the life-up amount of the sheet stacking member 206 when the sheet feeding cassette 201 is inserted. In such an image forming apparatus, in the case where the sheets are curled, the position of the uppermost surface of the sheets is raised, and therefore there is a problem such that the remaining sheet amount is notified as an amount larger than an actual stacking amount. In Embodiment 2, a method in which even in the state in which the sheets are curled, a remaining amount of the sheets 8 is accurately notified will be described.

In the image forming apparatus in this embodiment, similarly as in Embodiment 1, the initial lift-up (FIG. 5) is carried out after the sheet feeding cassette 201 is mounted in the main assembly 101. Then, the image forming apparatus notifies, after the initial lift-up is ended, a remaining sheet amount P (unit: %) which is 100% in a state in which a maximum number of sheets 8 stackable on the sheet stacking member 206. The remaining sheet amount P (%) can be calculated by the following formula (3).

$$P\ (\%)=((T\max-T1)/T\max)\times 100 \quad (3)$$

Here, a time T1 represents an elapsed time of the first timer in S107 of FIG. 5, i.e., a time until the sheet stacking member 206 raises from the state in which the sheet stacking member 206 is positioned on the bottom of the sheet feeding cassette 201 and the sensor 301 changes in state from the OFF state to the ON state by the stacked sheets 8. A time Tmax represents a time required to move the sheet stacking member 206 from the bottom to a uppermost surface. That is, the time Tmax represents a time until the sheet stacking member on which the sheets 8 are not stacked raises from the bottom of the sheet feeding cassette 201 and the detection flag 303 is raises by the sheet stacking member 206 and thus the sensor 301 is changed in state to the ON state. Incidentally, the remaining sheet amount P (%) calculated by the formula (3) is stored in the RAM 411*b*. Further, the CPU 411 calculates a life-up amount Lmax (unit: mm) in which the sheet stacking member 206 is raised from the bottom of the sheet feeding cassette 201 when the sheet stacking member 206 is raised for the time Tmax, and stores the life-up amount Lmax in the RAM 411*b*. The life-up amount Lmax may also be stored as a fixed value in the ROM 411*a* in advance.

As described above with reference to (a) of FIG. 6 in Embodiment 1, in the state in which the sheets 8 curled at their free end portions with respect to the feeding direction are stacked, the detection flag 303 are raised by the curled sheets 8. For that reason, erroneous detection is made as if the sheets 8 remain in an amount larger than an actual remaining amount, so that an accurate remaining sheet amount cannot be notified. Therefore, in this embodiment, a method in which a degree of the curl of the sheets 8 is detected during the sheet feeding operation after the initial lift-up is carried out and then the remaining sheet amount is corrected to a proper remaining sheet amount will be described.

[Control Sequence of Remaining Sheet Amount Notification]

Figure 9:
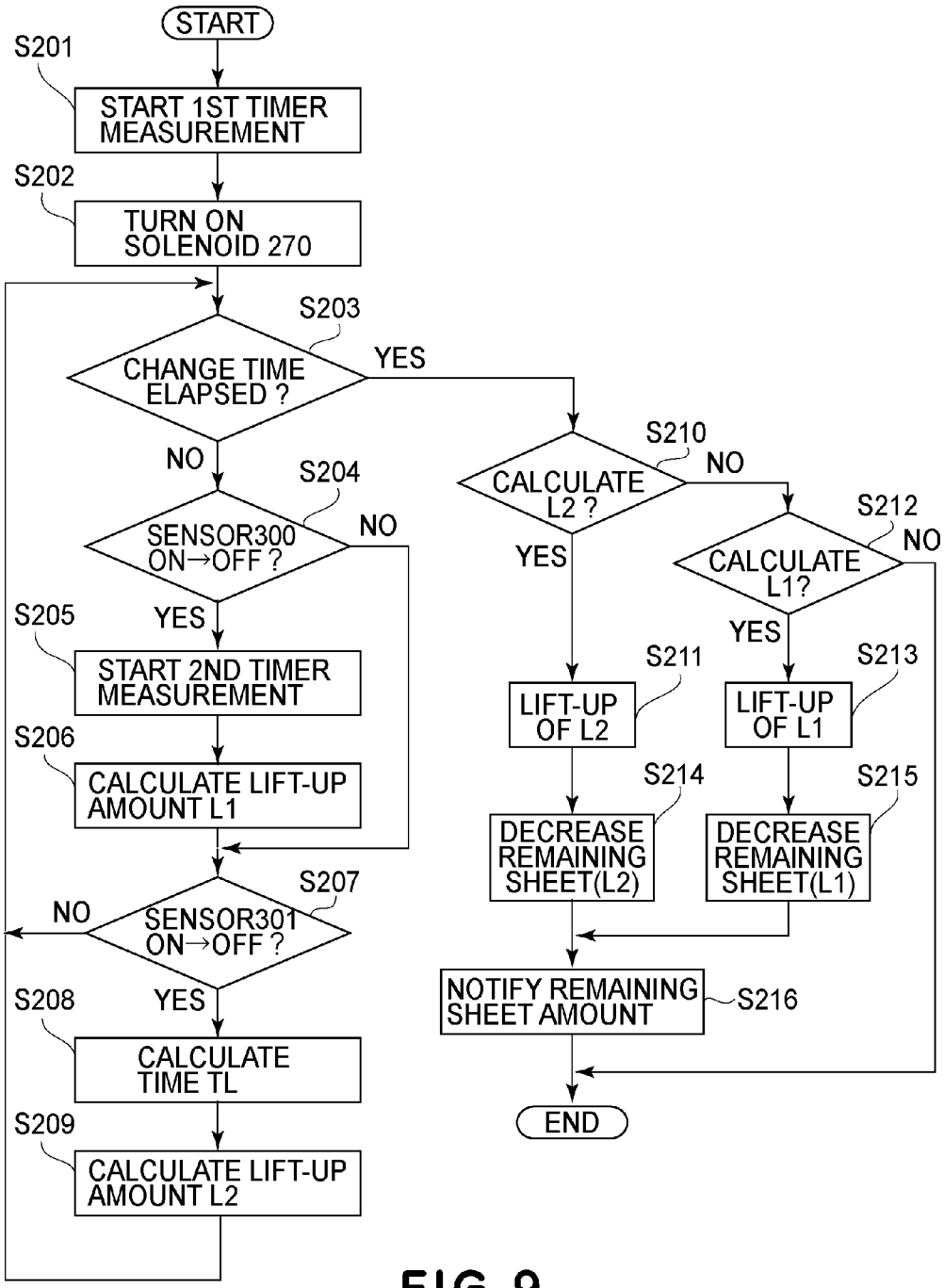
FIG. 9 is a flowchart showing a control sequence of the sheet feeding operation in Embodiment 2.

FIG. 9 is a flowchart showing a control sequence in which when the sheet feeding operation is performed, the additional life-up amount is determined depending on the degree of the curl of the sheets 8 and then depending on the life-up amount, the remaining sheet amount is notified. A process (sequence) shown in FIG. 9 is started when the sheet 8 is fed, and is executed by the CPU 411. In FIG. 9, the same processes those in FIG. 8 in Embodiment 1 described above are represented by the same step numbers. That is, the processes in S201-S213 in FIG. 9 are the same as those in S201-S213 in FIG. 8, and therefore will be omitted from description. In the following, processes in S214-S216 added in this embodiment will be described.

In S214, the CPU 411 reads a current remaining sheet amount P (%) stored in the RAM 411*b* and subtracts an amount corresponding to the life-up amount L2 from the read remaining sheet amount, and then stores a resultant amount in the RAM 411*b*. That is, the CPU 411 calculates a proportion (%) of the sheets 8 decreased in amount from the last notification by dividing the life-up amount L2 (mm) by the life-up amount Lmax (mm) at the time when the sheet stacking member 206 is raised for the time Tmax as described above. Then, the CPU 411 subtracts the proportion (%) of the decreased sheets 8 from the remaining sheet amount (%), during the last notification, stored in the RAM 411*b*, and stores the remaining sheet amount (%) after the subtraction.

In S215, the CPU 411 reads a current remaining sheet amount P (%) stored in the RAM 411*b* and subtracts an amount corresponding to the life-up amount L1 from the read remaining sheet amount, and then stores a resultant amount in the RAM 411*b*. That is, the CPU 411 calculates a proportion (%) of the sheets 8 decreased in amount from the last notification by dividing the life-up amount L1 (mm) by the life-up amount Lmax (mm) at the time when the sheet stacking member 206 is raised for the time Tmax as described above. Then, the CPU 411 subtracts the proportion (%) of the decreased sheets 8 from the remaining sheet amount (%), during the last notification, stored in the RAM 411*b*, and stores the remaining sheet amount (%) after the subtraction.

In S216, the CPU 411 reads the remaining sheet amount (%) stored in the RAM 411*b* and sends information on the remaining sheet amount (%) to the controller 401 via video interface 410, and then ends the sequence. Incidentally, the controller 401 displays the received remaining sheet amount (%) on the control panel 403, and notifies a user of the remaining sheet amount (%).

As described above, on the basis of the amount of the lift-up carried out depending on the states of the sensor 300 and the sensor 301, the remaining amount of the sheets 8 stacked on the sheet stacking member 206, and therefore an accurate remaining sheet amount can be notified even in the sheet feeding mechanism in this embodiment.

As described above, according to this embodiment, even in the state in which the sheets are curled, the sheet can be fed stably. Further, even in the state in which the sheets are curled, an accurate remaining amount of the sheets stacked on the sheet stacking member can be notified.

Embodiment 3

In Embodiment 2, the method in which the degree of the curl of the sheets was detected during the sheet feeding operation and then the proper remaining sheet amount (unit: %) was notified was described. In Embodiment 3, a method in which the remaining sheet amount is notified with further high accuracy using a media sensor will be described. Incidentally, constituent elements which are the same as those in Embodiment 1 are represented by the same reference numerals or symbols and will be omitted from description.

[Constitution of Media Sensor]

Figure 10:
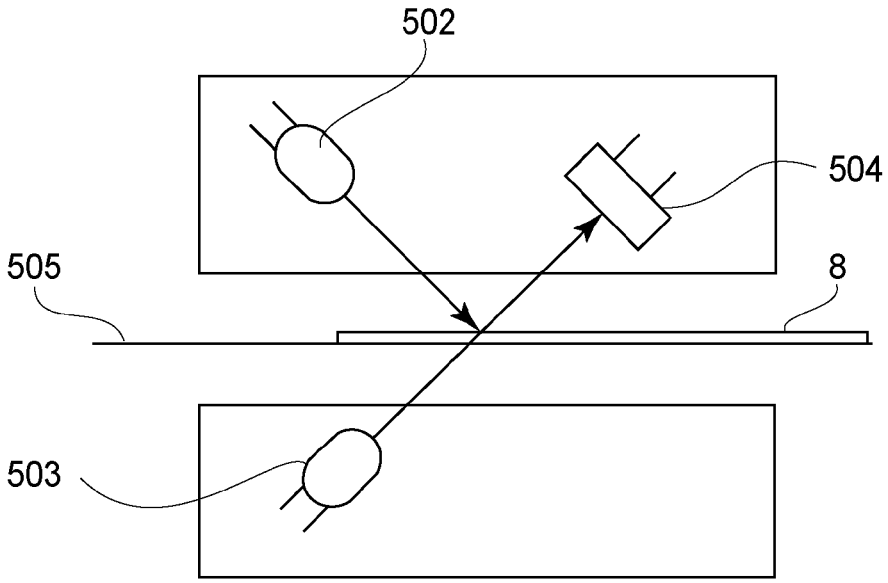
FIG. 10 is a schematic view for illustrating a media sensor in Embodiment 3.

A media sensor 501 as a third detecting portion is, as shown in FIG. 10, constituted by two light-emitting portions 502, 503 and a light-receiving portion 504. Light emitted from the light-emitting portion 502 is incident on the sheet 8 fed through the sheet feeding path along a feeding guide 505 with an angle of 45° with respect to the sheet 8 and is reflected by the sheet 8, and then is received as reflected light by the light-receiving portion 504. The media sensor 501 detects a surface property of the sheet 8 by this reflected light. Further, light emitted from the light-emitting portion 503 provided on an opposite side from the light-receiving portion 504 with respect to the sheet feeding path is incident on the sheet 8 fed through the sheet feeding path along a feeding guide 505 with an angle of 45° with respect to the sheet 8 and is reflected by the sheet 8, and then is received as transmitted light by the light-receiving portion 504. The media sensor 501 detects a thickness of the sheet 8 on the basis of a light-receiving amount of this transmitted light with respect to a light-emission amount. In the case of this embodiment, the media sensor 501 discriminates the sheet 8 into 3 species of papers consisting of "thin paper", "plain paper" and "thick paper" depending on the thickness of the sheet 8. Incidentally, the light-receiving portion 504 may be a photo-diode or may also be an area sensor for picking-up the received light as an image or a line sensor. The line sensor is a sensor extending in a direction (widthwise direction of the sheet 8) perpendicular to the feeding direction of the sheet 8 and is capable of performing image pick-up while feeding the sheet 8. As the media sensor 501, an ultrasonic sensor may also be used. The ultrasonic sensor includes a sending portion for sending ultrasonic waves and a receiving portion for receiving the ultrasonic waves sent from the sending portion. The ultrasonic sensor is capable of detecting a basis weight (weight per unit area) of the sheet 8 by reception of the ultrasonic waves, by the receiving portion, which are sent from the sending portion and which are attenuated through the sheet 8. There is a correlation between the basis weight and the thickness, i.e., when the basis weight is large, also the thickness is large, and therefore by detecting the basis weight of the sheet 8, the media sensor 501 can discriminate the species of the sheet 8 into 3 species.

[Notification of Remaining Sheet Amount]

In Embodiment 2, after the initial lift-up is carried out, the remaining sheet amount P (unit: %) which is 100% in the state in which the sheets 8 are fully stacked was notified. In this embodiment, the remaining sheet amount P is notified as the number of the sheets 8. The remaining sheet amount P (unit: sheet(s)) is calculated by a formula (4) shown below. Incidentally, immediately after the initial lift-up is carried out, the sheet feeding operation of the sheet 8 is not performed, and therefore also the detection of the sheet 8 by the media sensor 501 is not carried out. For that reason, as the remaining sheet amount P (sheet(s)) immediately after the initial lift-up is carried out, a remaining sheet amount P (sheet(s)) in the case where the sheet 8 is plain paper is notified.

$$P(\text{sheet(s)})=((T\text{max}-T1)/T\text{max})\times P\text{max} \quad (4)$$

Here, the time T1 and the time Tmax are the same as those in the formula (3) in Embodiment 2. That is, the time T1 represents a time until the sheet stacking member 206 raises from the state in which the sheet stacking member 206 is positioned on the bottom of the sheet feeding cassette 201 and the sensor 301 changes in state from the OFF state to the ON state by the stacked sheets 8. Further, the time Tmax represents a time until the sheet stacking member on which the sheets 8 are not stacked raises from the bottom of the sheet feeding cassette 201 and the detection flag 303 is raises by the sheet stacking member 206 and thus the sensor 301 is changed in state to the ON state. Further, a maximum sheet number Pmax represents a maximum number of sheets 8 (corresponding to the plain paper) stackable on the sheet stacking member 206. Incidentally, in the ROM 411*a*, information on a thickness (unit: mm) per (one) sheet of each of the thick paper, the thin paper and the plain paper has already been stored, and the CPU 411 reads the information on the thickness per sheet of the plain paper from the ROM 411*a*, and then calculates the maximum sheet number Pmax.

Further, in S107 of FIG. 5 in Embodiment 1, the CPU 411 calculates the initial lift-up amount L0 (unit: mm) of the CPU 411 and stores the initial lift-up amount L0 in the RAM 411*b*. In this embodiment, after the initial lift-up is ended, the CPU 411 stores the initial lift-up amount L0, as a total life-up amount Ltotal (unit: mm) representing a sum of life-up amounts of the sheet stacking member 206, in the RAM 411*b*.

[Control Sequence of Remaining Sheet Amount Notification]

Figure 11:
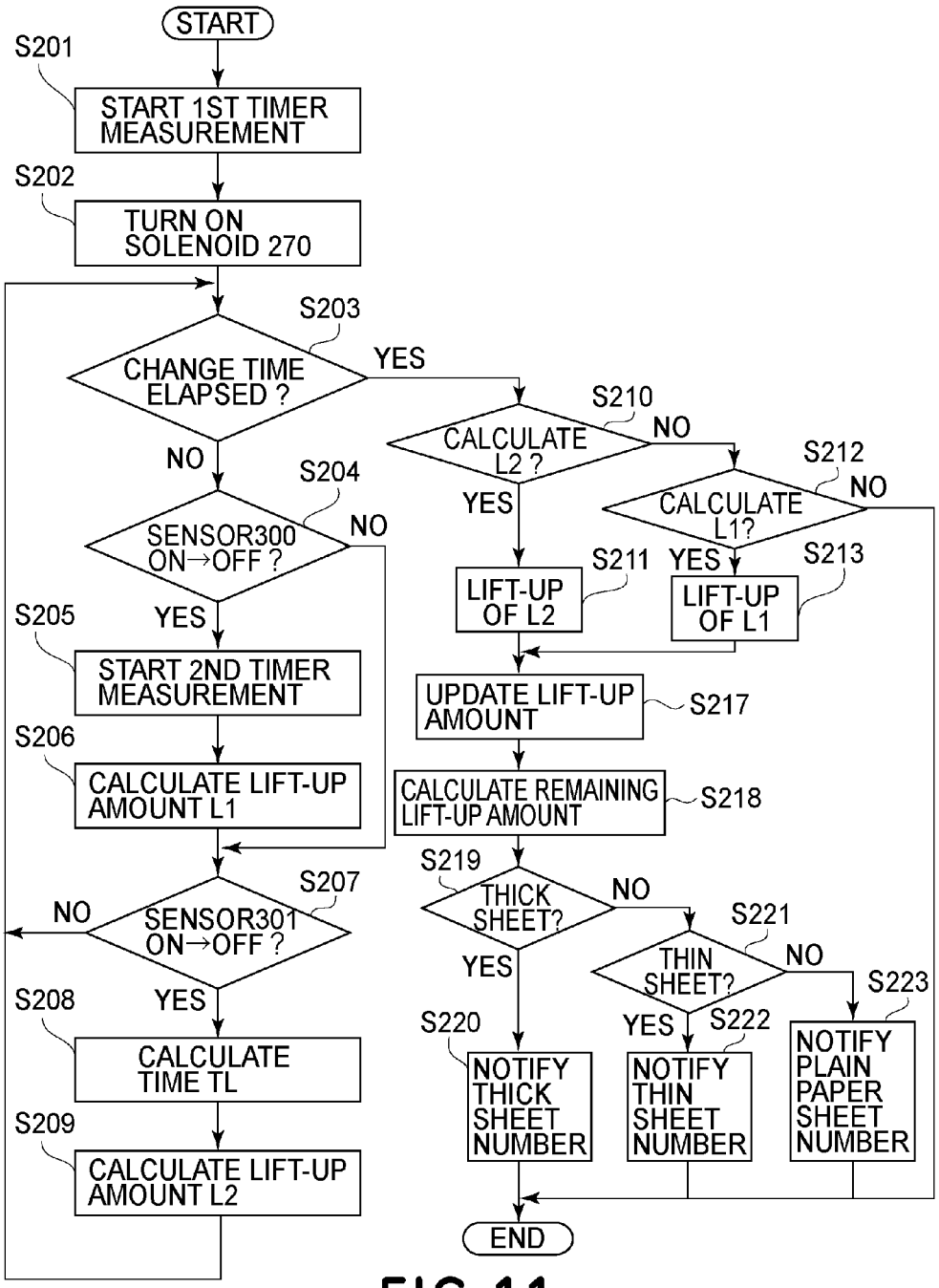
FIG. 11 is a flowchart showing a control sequence of the sheet feeding operation in Embodiment 3.

FIG. 11 is a flowchart showing a control sequence in which when the sheet feeding operation is performed, the additional life-up amount is determined depending on the degree of the curl of the sheets 8 and then depending on the life-up amount, the remaining sheet amount is notified. A process (sequence) shown in FIG. 11 is started when the sheet 8 is fed, and is executed by the CPU 411. In FIG. 11, the same processes those in FIG. 8 in Embodiment 1 described above are represented by the same step numbers. That is, the processes in S201-S213 in FIG. 11 are the same as those in S201-S213 in FIG. 8, and therefore will be omitted from description. In the following, processes in S217-S223 added in this embodiment will be described.

In S217, an update of the total life-up amount is made. That is, the CPU 411 reads, from the RAM 411*b*, the total life-up amount Ltotal (unit: mm) representing the sum of the life-up amounts of the sheet stacking member 206. Then, the CPU 411 adds the life-up amount L1 (unit: mm) or the life-up amount L2 (unit: mm), as a life-up amount in which the sheet stacking member 206 is currently lifted up, to the rad total life-up amount Ltotal (unit: mm), and then stores a resultant life-up amount in the RAM 411*b*.

In S218, the CPU 411 calculates a remaining life-up amount L (unit: mm) on the basis of a formula (5) shown below by subtracting the total life-up amount Ltotal (unit: mm) calculated in S217 from a maximum life-up amount Lmax (unit: mm).

$$L(\text{mm})=L\text{max}(\text{mm})-L\text{total}(\text{mm}) \quad (5)$$

Here, the maximum life-up amount (unit: mm) is a life-up amount (mm) required to move the sheet stacking member 206 from the bottom to the uppermost surface. The maximum life-up amount is, as described above, also a life-up amount in which when the sheet stacking member 206 is raised for the time Tmax, the sheet stacking member 206 is raised from the bottom of the sheet feeding cassette 201.

In S219, the CPU 411 acquires the species of the sheet 8 detected by the media sensor 501 described above, and discriminates whether or not the sheets 8 stacked on the sheet stacking member 206 are the thick paper. In the case where the CPU 411 discriminated that the sheets 8 are the thick paper, the sequence goes to a process of S220, and in the case where the CPU 411 discriminated that the sheets 8 are not the thick paper, the sequence goes to a process of S221. In S220, the CPU 411 calculates the remaining sheet amount P (sheet(s)) by dividing the remaining life-up amount L (mm) calculated in S218 by the thickness (mm) of the thick sheets 8 read from the ROM 411*a*. The CPU 411 sends the remaining sheet amount P (sheet(s)) to the controller 401 via a video interface 410, and then ends the sequence.

In S221, the CPU 411 acquires the species of the sheet 8 detected by the media sensor 501, and discriminates whether or not the sheets 8 stacked on the sheet stacking member 206 are the thin paper. In the case where the CPU 411 discriminated that the sheets 8 are the thin paper, the sequence goes to a process of S222, and in the case where the CPU 411 discriminated that the sheets 8 are not the thin paper, the sequence goes to a process of S223. In S222, the CPU 411 calculates the remaining sheet amount P (sheet(s)) by dividing the remaining life-up amount L (mm) calculated in S218 by the thickness (mm) of the thin sheets 8 read from the ROM 411*a*. The CPU 411 sends the remaining sheet amount P (sheet(s)) to the controller 401 via a video interface 410, and then ends the sequence. In S223, the CPU 411 calculates the remaining sheet amount P (sheet(s)) by dividing the remaining life-up amount L (mm) calculated in S218 by the thickness (mm) of the sheets 8 of the plain paper read from the ROM 411*a*. The CPU 411 sends the remaining sheet amount P (sheet(s)) to the controller 401 via a video interface 410, and then ends the sequence. Incidentally, the controller 401 displays, on the control panel 403, the remaining sheet amount (sheet(s)) received from the CPU 411, and then notifies the user of the remaining sheet amount (sheet(s)).

Incidentally, in this embodiment, the species of the sheets 8 detectable by the media sensor 501 is limited to the 3 species consisting of the thick paper, the thin paper and the plain paper, but the remaining sheet amount may also be determined depending on the species of the detectable sheet 8. Further, the species of the sheet 8 is not changed on the basis of a detection result of the media sensor 501, but may also be changed, for example, depending on a print mode in which the species of the sheet 8 designated through the control panel 403 is used.

As described above, the life-up amount is determined on the basis of the states of the sensor 300 and the sensor 301 and the remaining sheet amount is calculated depending on the detection result of the sheet 8 by the media sensor 501, whereby the remaining sheet amount can be notified with high accuracy even in the sheet feeding mechanism in this embodiment.

As described above, according to this embodiment, even in the state in which the sheets are curled, the sheet can be fed stably. Further, even in the state in which the sheets are curled, an accurate remaining amount of the sheets stacked on the sheet stacking member can be notified. In the above-described embodiments, the case where the curled sheets 8 are stacked on the sheet stacking member 206 was described. However, the present invention is not limited thereto. A similar problem can generate also in the case where the sheets 8 stacked on the sheet stacking member 206 are an envelope. That is, in a state in which the sheet feeding roller 202 is not press-contacted to the sheet 8, when the sheets are such a species of sheets that the gap generates between the stacked sheets 8, the similar problem can generate even when the sheets 8 are not curled.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-113070 filed on Jun. 3, 2015, which is hereby incorporated by reference herein in its entirety.

What is claimed is:

1. A sheet feeding device comprising:

a raising and lowering portion for raising and lowering a stacking member for stacking a sheet;

a first detecting portion for detecting whether or not an uppermost sheet stacked on said stacking member raised by said raising and lowering portion is in a feeding position;

a feeding portion for feeding the uppermost sheet by causing a feeding roller to press contact the uppermost sheet;

a second detecting portion for detecting whether or not the feeding roller is in a position where the feeding roller is capable of feeding the uppermost sheet; and a controller for controlling said raising and lowering portion, wherein said raising and lowering portion raises said stacking member and detection that the uppermost sheet is in the feeding position is made by said first detecting portion, and thereafter said feeding portion causes the feeding roller to press contact the uppermost sheet, and wherein when a change in a state of the feeding roller from a state in which the feeding roller is in the position where the feeding roller is capable of feeding the uppermost sheet to a state in which the feeding roller is not in the position where the feeding roller is capable of feeding the uppermost sheet is detected by said second detecting portion and then a change in a state of the uppermost sheet from a state in which the uppermost sheet is in the feeding position to a state in which the uppermost sheet is not in the feeding position is detected by said first detecting portion, said controller determines a correction amount on the basis of a time from change timing of said second detecting portion to change timing of said first detecting portion and controls said raising and lowering portion to raise said stacking member on the basis of the correction amount.

2. A sheet feeding device according to claim 1, wherein when a change in a state of the feeding roller from a state in which the feeding roller is in the position where the feeding roller is capable of feeding the uppermost sheet to a state in which the feeding roller is not in the position where the feeding roller is capable of feeding the uppermost sheet is detected by said second detecting portion and when a change in a state of the uppermost sheet from a state in which the uppermost sheet is in the feeding position to a state in which the uppermost sheet is not in the feeding position is not detected by said first detecting portion, said controller determines a correction amount smaller than said correction amount determined on the basis of the time and controls said raising and lowering portion to raise said stacking member.

3. A sheet feeding device according to claim 1, wherein when a change in a state of the feeding roller from a state in which the feeding roller is in the position where the feeding roller is capable of feeding the uppermost sheet to a state in which the feeding roller is not in the position where the feeding roller is capable of feeding the uppermost sheet is not detected by said second detecting portion and when a change in a state of the uppermost sheet from a state in which the uppermost sheet is in the feeding position to a state in which the uppermost sheet is not in the feeding position is not detected by said first detecting portion, said controller does not control said raising and lowering portion and said feeding portion feeds the uppermost sheet by the feeding roller.

4. A sheet feeding device according to claim 1, wherein when the time is long, said controller increases the correction amount compared with when the time is short.

5. A sheet feeding device according to claim 1, wherein said feeding portion effects contact and spacing of the feeding roller relative to the uppermost sheet every feeding of one sheet.

6. A sheet feeding device according to claim 1, wherein the feeding roller press contacts the uppermost sheet to correct a curl state of the sheet stacked on said stacking member.

7. A sheet feeding device according to claim 1, wherein said controller controls said raising and lowering portion on the basis of the time to raise said stacking member to a position higher than the feeding position.

8. A sheet feeding device according to claim 7, wherein after said stacking member is raised correspondingly to the determined correction amount, said feeding portion feeds the uppermost sheet by the feeding roller.

9. An image forming apparatus according to claim 1, wherein said controller determines a remaining sheet amount of the sheet stacked on said stacking member on the basis of the determined correction amount.

10. A sheet feeding device according to claim 9, wherein the remaining sheet amount is a proportion to a maximum number of sheets capable of being stacked on the stacking member.

11. A sheet feeding device according to claim 9, wherein the remaining sheet amount is a number of sheets stacked on the stacking member.

12. A sheet feeding device according to claim 11, wherein the number of sheets is a number of sheets depending on a species of paper of the sheets.

13. An image forming apparatus comprising:

a raising and lowering portion for raising and lowering a stacking member for stacking a sheet;

a first detecting portion for detecting whether or not an uppermost sheet stacked on said stacking member raised by said raising and lowering portion is in a feeding position;

a feeding portion for feeding the uppermost sheet by causing a feeding roller to press contact the uppermost sheet;

a second detecting portion for detecting whether or not the feeding roller is in a position where the feeding roller is capable of feeding the uppermost sheet; and a controller for controlling said raising and lowering portion, wherein said raising and lowering portion raises said stacking member and detection that the uppermost sheet is in the feeding position is made by said first detecting portion, and thereafter said feeding portion causes the feeding roller to press contact the uppermost sheet, and wherein when a change in a state of the feeding roller from a state in which the feeding roller is in the position where the feeding roller is capable of feeding the uppermost sheet to a state in which the feeding roller is not in the position where the feeding roller is capable of feeding the uppermost sheet is detected by said second detecting portion and then a change in a state of the uppermost sheet from a state in which the uppermost sheet is in the feeding position to a state in which the uppermost sheet is not in the feeding position is detected by said first detecting portion, said controller determines a correction amount on the basis of a time from change timing of said second detecting portion to change timing of said first detecting portion and controls said raising and lowering portion to raise said stacking member on the basis of the correction amount.

14. An image forming apparatus according to claim 13, wherein said controller determines a remaining sheet amount of the sheet stacked on said stacking member on the basis of the determined correction amount.

15. An image forming apparatus according to claim 14, further comprising:

a notifying portion for notifying information, wherein said notifying portion notifies the remaining sheet amount.

16. An image forming apparatus according to claim 15, further comprising:

a third detecting portion for detecting a species of paper of the sheet, wherein said notifying portion notifies a number of sheets depending on the species of paper of the sheet detected by said third detecting portion.

* * * * *